US005229240A

United States Patent [19]

Kato et al.

[11] Patent Number: 5,229,240

[45] Date of Patent: Jul. 20, 1993

[54] ELECTROPHOTOGRAPHIC LIGHT-SENSITIVE MATERIAL

[75] Inventors: Eiichi Kato; Seishi Kasai; Kazuo Ishii, all of Shizuoka, Japan

[73] Assignee: Fuji Photo Film Co., Ltd., Kanagawa, Japan

[21] Appl. No.: 701,909

[22] Filed: May 17, 1991

[30] Foreign Application Priority Data

May 18, 1990 [JP] Japan ..... 2-126783

[51] Int. Cl.[5] ..... G03G 5/05

[52] U.S. Cl. ..... 430/96; 430/56; 430/95

[58] Field of Search ..... 430/49, 95, 96, 910, 430/56

[56] References Cited

U.S. PATENT DOCUMENTS

| | | | |
|---|---|---|---|
| 4,284,707 | 8/1981 | Nagasawa et al. | 430/196 |
| 4,681,833 | 7/1987 | Nagasawa et al. | 430/175 |
| 4,954,407 | 9/1990 | Kato et al. | 430/96 |
| 5,009,975 | 4/1991 | Kato et al. | 430/96 |
| 5,084,367 | 1/1992 | Kato et al. | 430/96 |

FOREIGN PATENT DOCUMENTS

| | | |
|---|---|---|
| 0361514 | 4/1990 | European Pat. Off. . |
| 0362804 | 4/1990 | European Pat. Off. . |

*Primary Examiner*—Marion E. McCamish
*Assistant Examiner*—Rosemary Ashton
*Attorney, Agent, or Firm*—Sughrue, Mion, Zinn, Macpeak & Seas

[57] ABSTRACT

An electrophotographic light-sensitive material comprising a support having provided thereon a photoconductive layer containing at least an inorganic photoconductive substance, a spectral sensitizer and a binder resin, wherein the binder resin contains (1) at least one resin (Resin (A)) having a weight average molecular weight of from $1\times10^3$ to $1\times10^4$ which contains at least 30% by weight of a polymer component represented by the general formula (I) described below and from 0.1 to 10% by weight of a polymer component containing at least one acidic group selected from $$-PO_3H_2,\ -SO_3H,\ -COOH,\ -\overset{\overset{\displaystyle O}{\|}}{\underset{\underset{\displaystyle OH}{|}}{P}}-R$$

(wherein R represents a hydrocarbon group or —OR′ (wherein R′ represents a hydrocarbon group) and a cyclic acid anhydride-containing group, and (2) at least one resin (Resin (B)) having a weight average molecular weight of $5\times10^4$ or more, containing a recurring unit represented by the general formula (III) described below as a copolymer component, and having a cross-linked structure made before the preparation of a dispersion for forming the photoconductive layer:

$$\left(\underset{\underset{\displaystyle H}{|}}{\overset{\overset{\displaystyle C_1}{|}}{C}}-\underset{\underset{\displaystyle X-R_{21}}{|}}{\overset{\overset{\displaystyle C_2}{|}}{C}}\right) \qquad \text{(III)}$$

13 Claims, No Drawings

ELECTROPHOTOGRAPHIC LIGHT-SENSITIVE MATERIAL

FIELD OF THE INVENTION

The present invention relates to an electrophotographic light-sensitive material, and more particularly to an electrophotographic light-sensitive material which is excellent in electrostatic charging characteristics and pre-exposure fatigue resistance.

BACKGROUND OF THE INVENTION

An electrophotographic light-sensitive material may have various structures depending upon the characteristics required or an electrophotographic process being employed.

An electrophotographic system in which the light-sensitive material comprises a support having thereon at least one photoconductive layer and, if desired, an insulating layer on the surface thereof is widely employed. The electrophotographic light-sensitive material comprising a support and at least one photoconductive layer formed thereon is used for the image formation by an ordinary electrophotographic process including electrostatic charging, imagewise exposure, development, and, if desired, transfer.

Furthermore, a process of using an electrophotographic light-sensitive material as an offset master plate for direct plate making is widely practiced.

Binders which are used for forming the photoconductive layer of an electrophotographic light-sensitive material are required to be excellent in the film-forming property by themselves and the capability of dispersing a photoconductive powder therein. Also, the photoconductive layer formed using the binder is required to have satisfactory adhesion to a base material or support. Further, the photoconductive layer formed by using the binder is required to have various excellent electrostatic characteristics such as high charging capacity, small dark decay, large light decay, and less fatigue due to pre-exposure and also have an excellent image forming properties, and the photoconductive layer stably maintaining these electrostatic characteristics in spite of the change of humidity at the time of image formation.

Binder resins which have been conventionally used include silicone resins (e.g., JP-B-34-6670) (the term "JP-B" as used herein means an "examined Japanese patent publication"), styrene-butadiene resins (e.g., JP-B-35-1960), alkyd resins, maleic acid resins, polyamides (e.g., JP-B-35-11219), vinyl acetate resins (e.g., JP-B-41-2425), vinyl acetate copolymers (e.g., JP-B-41-2426), acrylic resins (JP-B-35-11216), and acrylic acid ester copolymers (e.g., JP-B-35-11219, JP-B-36-8510, and JP-B-41-13946).

However, in the electrophotographic light-sensitive materials using these binder resins, there are various problems such as 1) the affinity of the binder resin with a photoconductive powder is poor thereby reducing the dispersibility of the coating composition containing them, 2) the charging property of the photoconductive layer containing the binder resin is low, 3) the quality (in particular, dot image reproducibility and resolving power) of the image portions of duplicated images is poor, 4) the image quality is liable to be influenced by the environmental conditions (e.g., high temperature and high humidity or low temperature and low humidity) at the time of the formation of the duplicated image, and 5) the photoconductive layer is insufficient in film strength and adhesion to the support, which causes, when the light-sensitive material is used for an offset master, peeling off of the photoconductive layer at offset printing, resulting in decrease of the number of prints.

In order to improve electrostatic characteristics of the photoconductive layer, various attempts have hitherto been made. For example, incorporation of a compound having an aromatic ring or a furan ring containing a carboxy group or a nitro group either alone or in combination with a dicarboxylic anhydride in a photoconductive layer is disclosed in JP-B-42-6878 and JP-B-45-3073. However, the thus improved electrophotographic light-sensitive materials are yet insufficient in electrostatic characteristics and, in particular, light-sensitive materials having excellent light decay characteristics have not yet been obtained. Thus, for compensating the insufficient sensitivity of these light-sensitive materials, an attempt has been made to incorporate a large amount of a sensitizing dye into the photoconductive layer. However, light-sensitive materials containing a large amount of a sensitizing dye undergo considerable deterioration of whiteness to reduce the quality as a recording medium, and sometimes causing deterioration in dark decay characteristics, whereby satisfactory reproduced images are not obtained.

On the other hand, JP-A-60-10254 (the term "JP-A" as used herein means an "unexamined published Japanese patent application") discloses a method of using a binder resin for a photoconductive layer by controlling an average molecular weight of the resin. More specifically, JP-A-60-10254 discloses a technique for improving the electrostatic characteristics (in particular, reproducibility at repeated use as a PPC light-sensitive material) and moisture resistance of the photoconductive layer by using an acrylic resin having an acid value of from 4 to 50 and an average molecular weight of from $1\times10^3$ to $1\times10^4$ and an acrylic resin having an acid value of from 4 to 50 and an average molecular weight of from $1\times10^4$ to $2\times10^5$ in combination.

Furthermore, extensive investigations on lithographic printing plate precursors using electrophotographic light-sensitive materials have been made and various binder resins for a photoconductive layer have been proposed as satisfying both the electrostatic characteristics as an electrophotographic light-sensitive material and the printing characteristics as a printing plate precursor. For example, JP-B-50-31011 discloses a combination of a resin having a molecular weight of from $1.8\times10^4$ to $10\times10^4$ and a glass transition point (Tg) of from 10° to 80° C. obtained by copolymerization of a (meth)acrylate monomer and other monomers in the presence of fumaric acid and a copolymer composed of a (meth)acrylate monomer and a copolymerizable monomer other than fumaric acid, JP-A-53-54027 discloses a terpolymer containing a (meth)acrylic acid ester unit with a substituent having a carboxylic acid group at least 7 atoms apart from the ester linkage, JP-A-54-20735 and JP-A-57-202544 disclose a tetra- or pentapolymer containing an acrylic acid unit and a hydroxyethyl (meth)acrylate unit, and JP-A-58-68046 discloses a terpolymer containing a (meth)acrylic acid ester unit with an alkyl group having from 6 to 12 carbon atoms as a substituent and a vinyl monomer containing a carboxyl group as effective for improving oil-desensitizing property of the photoconductive layer.

However, when the above described resins effective for improving electrostatic characteristics, moisture resistance and durability are practically used, it is found that they have problems in electrostatic characteristics, particularly charging property, dark charge retention characteristic and photosensitivity, and smoothness of the photoconductive layer, and they are still insufficient.

Also, as the result of evaluations on the binder resins which have been developed for electrophotographic lithographic printing plate precursors, it has been found that they have problems in the above-described electrostatic characteristics and background stains of prints.

For solving these problems, JP-A-63-217354 discloses a resin having a weight average molecular weight of from $10^3$ to $10^4$ and containing from 0.05 to 10% by weight of a copolymerizable component having an acidic group in the side chain of the copolymer as a binder resin, JP-A-1-100554 discloses a binder resin further containing a curable group-containing copolymerizable component together with the above-described acidic group-containing copolymerizable component, JP-A-1-102573 discloses a binder resin using a crosslinking agent together with the above-described acidic group-containing resin, JP-A-63-220149, JP-A-63-220148, and JP-A-64-564 disclose a binder resin using a high molecular weight resin having a weight average molecular weight of at least $1\times10^4$ in combination with the above-described acidic group-containing resin, and JP-A-1-102573, JP-A-2-34860, JP-A-2-40660; JP-A-2-53064 and JP-A-2-56558 disclose a binder resin using a heat- and/or photo-curable resin, a partially crosslinked polymer or a comb-like copolymer in combination with the above-described acidic group-containing resin.

On the other hand, as other binder resins for electrophotographic light-sensitive materials for solving the above-described problems, JP-A-1-70761 discloses a binder resin using a resin having a weight average molecular weight of from $1\times10^3$ to $1\times10^4$ having an acidic group at the terminal of the polymer main chain, JP-A-1-214865 discloses a binder resin using the above-described resin further containing a curable group-containing component as a copolymerizable component, JP-A-2-874 discloses a binder resin using a cross-linking agent together with the above-described resin, JP-A-1-280761, JP-A-1-116643, and JP-A-1-169455 disclose a binder resin using a high molecular weight resin having a weight average molecular weight of at least $1\times10^4$ in combination with the above-described resin, and JP-A-2-34859, JP-A-2-96766 and JP-A-2-103056 disclose a binder resin using a heat- and photo-curable resin, a partially crosslinked polymer or a comb-like copolymer in combination with the above-described resin.

However, it has been found that these resins still have problems in maintenance of the stable high performance when the electrophotographic light-sensitive materials are exposed to noticeably severe conditions.

More specifically, it has been found that, when a charging speed is increased in a charging step of the light-sensitive material, uneven charging occurs, which results in causing unevenness in the duplicated images, or, when a duplicating operation is carried out immediately after irradiating the surface of the electrophotographic light-sensitive material with light such as that from a fluorescent lamp, as a supplemental operation for a copying machine, the duplicated images obtained are deteriorated (in particular, decrease in image density, lowering of resolving power, and the occurrence of background fog) (so-called pre-exposure fatigue).

Furthermore, when the electrophotographic light-sensitive material described above is used as a lithographic printing plate precursor by an electrophotographic system, the resulting printing plate has the duplicated images of deteriorated image quality in the case of carrying out the duplication under the above-described condition, and, when printing is conducted using the plate, serious problems may occur such as degradation of image quality and the occurrence of background stains.

SUMMARY OF THE INVENTION

The present invention has been made for solving the above described problems of conventional electrophotographic light-sensitive materials.

An object of the present invention is, therefore, to provide a CPC electrophotographic light-sensitive material having improved electrostatic charging characteristics and pre-exposure fatigue resistance.

Another object of the present invention is to provide a lithographic printing plate precursor by an electrophotographic system capable of providing a number of prints having clear images.

Other objects of the present invention will become apparent from the following description and examples.

It has now been found that the above-described objects of the present invention are accomplished by an electrophotographic light-sensitive material comprising a support having provided thereon a photoconductive layer containing at least an inorganic photoconductive substance, a spectral sensitizer and a binder resin, wherein the binder resin contains (1) at least one resin (Resin (A)) having a weight average molecular weight of from $1\times10^3$ to $1\times10^4$ which contains at least 30% by weight of a polymer component represented by the general formula (I) described below and from 0.1 to 10% by weight of a polymerizable component containing at least one acidic group selected from $$-PO_3H_2,\ -SO_3H,\ -COOH,\ -\overset{\overset{\displaystyle O}{\|}}{\underset{\underset{\displaystyle OH}{|}}{P}}-R$$

(wherein R represents a hydrocarbon group or —OR' (wherein R' represents a hydrocarbon group) and a cyclic acid anhydride-containing group, and which has at least one acidic group selected from the above-described acidic groups at one terminal of the main chain of the copolymer;

$$\left(\overset{\overset{\displaystyle a_1}{|}}{CH}-\overset{\overset{\displaystyle a_2}{|}}{\underset{\underset{\displaystyle COO-R_1}{|}}{C}}\right) \qquad (I)$$

wherein $a_1$ and $a_2$ each represents a hydrogen atom, a halogen atom, a cyano group or a hydrocarbon group; and $R_1$ represents a hydrocarbon group; and (2) at least one resin (Resin (B)) having a weight average molecular weight of $5\times10^4$ or more, containing a repeating unit represented by the general formula (III) described below as a copolymer component, and having a cross-linked structure made before the preparation of a dispersion for forming the photoconductive layer:

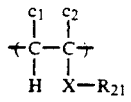

(III)

wherein X represents —COO—, —OCO—, —$CH_2$OCO—, —$CH_2$COO—, —O—, or —$SO_2$—; $R_{21}$ represents a hydrocarbon group having from 1 to 22 carbon atoms; and $c_1$ and $c_2$, which may be the same or different, each represents a hydrogen atom, a halogen atom, a cyano group, a hydrocarbon group having from 1 to 8 carbon atoms, —$COOZ_1$, or —$COOZ_1$ bonded through a hydrocarbon group having from 1 to 8 carbon atoms, wherein $Z_1$ represents a hydrocarbon group having from 1 to 18 carbon atoms.

DETAILED DESCRIPTION OF THE INVENTION

The binder resin which can be used in the present invention comprises at least (1) a low-molecular weight resin (hereinafter referred to as resin (A)) containing a polymer component having the specific repeating unit and a polymer component having the specific acidic group (hereinafter, the term "acidic group" used in the present invention includes a cyclic acid anhydride-containing group, unless otherwise indicated) and having an acidic group at one terminal of the polymer main chain and (2) a high-molecular weight resin (hereinafter referred to as resin (B)) containing a repeating unit represented by the general formula (III) and having the crosslinked structure previously made.

As described above, it is known that a resin containing an acidic group-containing polymer component and a resin having an acidic group at the terminal of the main chain thereof are known as binder resin for an electrophotographic light-sensitive material, but, as described in the present invention, it has been surprisingly found that the above-described problems in conventional techniques can be first solved by using the resin containing the acidic group containing component in the main chain of the polymer and having an acidic group also at the terminal of the polymer main chain.

According to a preferred embodiment of the present invention, the low-molecular weight resin (A) is a low molecular weight resin (hereinafter sometimes referred to as resin (A')) having the acidic group at the terminal and containing the acidic group-containing component and a methacrylate component having a specific substituent containing a benzene ring or a naphthalene ring represented by the following general formula (IIa) or (IIb):

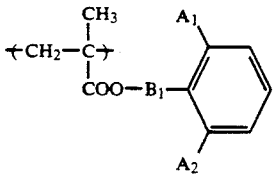

(IIa)

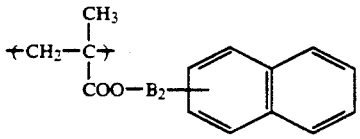

(IIb)

wherein $A_1$ and $A_2$ each represents a hydrogen atom, a hydrocarbon group having from 1 to 10 carbon atoms, a chlorine atom, a bromine atom, —$COD_1$ or —$COOD_2$, wherein $D_1$ and $D_2$ each represents a hydrocarbon group having from 1 to 10 carbon atoms; and $B_1$ and $B_2$ each represents a mere bond or a linking group containing from 1 to 4 linking atoms, which connects —COO— and the benzene ring.

In another preferred embodiment of the present invention, the high-molecular weight resin (B) is a resin (hereinafter sometimes referred to as resin (B')) in which at least one polymer main chain has at least one polar group selected from

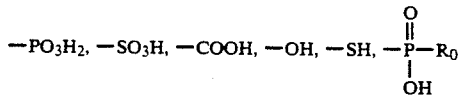

(wherein $R_0$ represents a hydrocarbon group or —$OR_0'$, wherein $R_0'$ represents a hydrocarbon group), a cyclic acid anhydride-containing group,

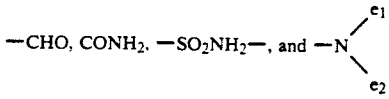

(wherein $e_1$ and $e_2$, which may be the same or different, each represents a hydrogen atom or a hydrocarbon group) at only one terminal thereof.

In the present invention, it has been found that, in the dispersion system containing at least an inorganic photoconductive substance and a spectral sensitizer, the low-molecular weight resin (A) effectively adsorbs onto the stoichiometric defects of the photoconductive substance without hindering the adsorption of the spectral sensitizer onto the inorganic photoconductive substance, can adequately improve the coating property on the surface of the photoconductive substance, compensates the traps of the photoconductive substance, ensures the sensitivity increasing effect of the photoconductive substance with the spectral sensitizer, greatly improves the moisture resistance, and further sufficiently disperses the photoconductive substance to inhibit the occurrence of aggregation of the photoconductive substance.

Also, the resin (B) serves to sufficiently heighten the mechanical strength of the photoconductive layer which may be insufficient in case of using the resin (A) alone, without damaging the excellent electrophotographic characteristics attained by the use of the resin (A).

It is believed that, by specifying the weight average molecular weight of each of the resin (A) and the resin (B) and the contents and the positions of the acidic groups bonded in the resin as the binder resin for the inorganic photoconductive substance according to the present invention, the strength of the interaction of the inorganic photoconductive substance, spectral sensitizer and resins can be properly changed in the dispersed state of these components and the dispersion state can be stably maintained.

Thus, it is believed that, for the reasons described above, the electrostatic charging characteristics are improved, uneven charging does not occur, and the pre-exposure fatigue resistance is improved.

In case of using the resin (A'), the electrophotographic characteristics, particularly, $V_{10}$, DRR and $E_{1/10}$ of the electrophotographic material can be furthermore improved as compared with the use of the resin (A). While the reason for this fact is not fully clear, it is believed that the polymer molecular chain of the resin (A') is suitably arranged on the surface of inorganic photoconductive substance such as zinc oxide in the layer depending on the plane effect of the benzene ring or the naphthalene ring which is an ester component of the methacrylate whereby the above described improvement is achieved.

When the resin (B') is employed, the electrostatic Characteristics, particularly, DRR and $E_{1/10}$ of the electrophotographic material are further improved without damaging the excellent characteristics due to the resin (A), and these preferred characteristics are almost maintained in the case of greatly changing the environmental conditions from high temperature and high humidity to low temperature and low humidity.

Also, in the present invention, the smoothness of surface of the photoconductive layer can be improved. When an electrophotographic light-sensitive material having a photoconductive layer of rough surface is used as a lithographic printing plate precursor by an electrophotographic system, since the dispersion state of inorganic particles as a photoconductive substance and a binder resin is improper and the photoconductive layer is formed in a state containing aggregates thereof, whereby when the photoconductive layer is subjected to an oil-desensitizing treatment with an oil-desensitizing solution, the non-image areas are not uniformly and sufficiently rendered hydrophilic to cause attaching of printing ink at printing, which results in causing background stains at the non-image portions of the prints obtained.

In the case of using the binder resin according to the present invention, the interaction of the adsorption and coating of the inorganic photoconductive substance and the binder resin is adequately performed, and the film strength of the photoconductive layer is maintained.

Moreover, since the deterioration of the image quality and the formation of the background fog caused by uneven charging or pre-exposure fatigue do not occur, prints having remarkably excellent images can be obtained when the electrophotographic light-sensitive material of the present invention is used as a lithographic printing plate precursor.

Now, the resin (A) which can be used in the present invention will be explained in greater detail below.

In the resin (A), the weight average molecular weight is from $1\times10^3$ to $1\times10^4$, and preferably from $3\times10^3$ to $8\times10^3$, the content of the polymer component corresponding to the repeating unit represented by the general formula (I) is at least 30% by weight, and preferably from 50 to 97% by weight. The total content of the acidic groups in the acidic group-containing copolymer component and the acidic group bonded to the terminal of the main chain is preferably from 1 to 20% by weight. Furthermore, the content of the copolymer component containing the acidic group is preferably from 0.1 to 10% by weight, and more preferably from 0.5 to 8% by weight, and the content of the acidic group bonded to the terminal of the main chain is preferably from 0.5 to 15% by weight, and more preferably from 1 to 10% by weight.

Also, the content of the copolymer component of the methacrylate corresponding to the repeating unit represented by the general formula (IIa) and/or (IIb) in the resin (A') is at least 30% by weight, and preferably from 50 to 97% by weight, and the content of the copolymer component containing the acidic group is preferably from 0.1 to 10% by weight, and more preferably from 0.5 to 8% by weight. Also, the content of the acidic group bonded to the terminal of the polymer chain is preferably from 0.5 to 15% by weight, and more preferably from 1 to 10% by weight.

The glass transition point of the resin (A) is preferably from −20° C. to 110° C., and more preferably from −10° C. to 90° C.

If the molecular weight of the resin (A) is less than $1\times10^3$, the film-forming property thereof is reduced, and a sufficient film strength cannot be maintained. On the other hand, if the molecular weight of the resin (A) is higher than $1\times10^4$, the fluctuations of the electrophotographic characteristics (charging property and pre-exposure fatigue resistance) under the above-described severe conditions become somewhat larger, and the effect of the present invention for obtaining stable duplicated images is reduced.

If the total content of the acidic groups in the resin (A) is less than 1% by weight, the initial potential is low and a sufficient image density cannot be obtained. On the other hand, if the total acidic group content is larger than 20% by weight, the dispersibility is reduced even if the molecular weight of the resin (A) is low, the smoothness of the layer and the electrophotographic characteristics at high humidity are reduced, and further, when the light-sensitive material is used as an offset master plate, the occurrence of background stains is increased.

The resin (A) used in the present invention contains at least one repeating unit represented by the general formula (I) as a polymer component as described above.

In the general formula (I), $a_1$ and $a_2$ each represents a hydrogen atom, a halogen atom (e.g., chlorine and bromine), a cyano group or a hydrocarbon group, preferably including an alkyl group having from 1 to 4 carbon atoms (e.g., methyl, ethyl, propyl and butyl). $R_1$ preferably represents an alkyl group having from 1 to 18 carbon atoms which may be substituted (e.g., methyl, ethyl, propyl, butyl, pentyl, hexyl, octyl, decyl, dodecyl, tridecyl, tetradecyl, 2-chloroethyl, 2-bromoethyl, 2-cyanoethyl, 2-hydroxyethyl, 2-methoxyethyl, 2-ethoxyethyl, and 3-hydroxypropyl), an alkenyl group having from 2 to 18 carbon atoms which may be substituted (e.g., vinyl, allyl, isopropenyl, butenyl, hexenyl, heptenyl, and octenyl), an aralkyl group having from 7 to 12 carbon atoms which may be substituted (e.g., benzyl, phenethyl, naphthylmethyl, 2-naphthylethyl, methoxybenzyl, ethoxybenzyl, and methylbenzyl), a cycloalkyl group having from 5 to 8 carbon atoms which may be substituted (e.g., cyclopentyl, cyclohexyl, and cycloheptyl), or an aryl group which may be substituted (e.g., phenyl, tolyl, xylyl, mesityl, naphthyl, methoxyphenyl, ethoxyphenyl, fluorophenyl, difluorophenyl, bromophenyl, chlorophenyl, dichlorophenyl, iodophenyl, methoxycarbonylphenyl, ethoxycarbonylphenyl, cyanophenyl, and nitrophenyl).

More preferably, the polymer component corresponding to the repeating unit represented by the general formula (I) is a methacrylate component having the specific aryl group represented by the general formula (IIa) and/or (IIb) (Resin (A')) described above.

In the general formula (IIa), $A_1$ and $A_2$ each preferably represents a hydrogen atom, a chlorine atom, a bromine atom, a hydrocarbon group (preferably, an alkyl group having from 1 to 4 carbon atoms (e.g., methyl, ethyl, propyl, and butyl), an aralkyl group having from 7 to 9 carbon atoms which may be substituted (e.g., benzyl, phenethyl, 3-phenylpropyl, chlorobenzyl, dichlorobenzyl, bromobenzyl, methylbenzyl, methoxybenzyl, and chloromethylbenzyl), an aryl group which may be substituted (e.g., phenyl, tolyl, xylyl, bromophenyl, methoxyphenyl, chlorophenyl, and dichlorophenyl), $—COD_1$ or $—COOD_2$, wherein $D_1$ and $D_2$ each preferably represents any of the above-recited hydrocarbon groups as preferred hydrocarbon groups for $A_1$ and $A_2$.

In the general formula (IIa), $B_1$ is a mere bond or a linking group containing from 1 to 4 linking atoms, e.g., $\text{-}(CH_2)_{n1}\text{-}$ ($n_1$ represents an integer of 1, 2 or 3), $—CH_2OCO—$, $—CH_2CH_2OCO—$, $\text{-}(CH_2O)_{n2}\text{-}$ ($n_2$ represents an integer of 1 or 2), and $—CH_2CH_2O—$, which connects —COO— and the benzene ring.

In the general formula (IIb), $B_2$ has the same meaning as $B_1$ in the general formula (Ia).

Specific examples of the copolymer component corresponding to the repeating unit represented by the general formula (IIa) or (IIb) which can be used in the resin (A') according to the present invention are described below, but the present invention should not be construed as being limited thereto. In the following formulae, $T_1$ and $T_2$ each represents Cl, Br or I; $R_{11}$ represents

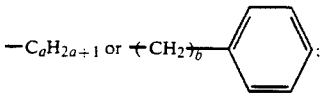

a represents an integer of from 1 to 4; b represents an integer of from 0 to 3; and c represents an integer of from 1 to 3.

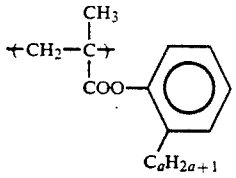
i-1)

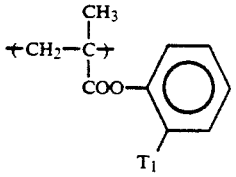
i-2)

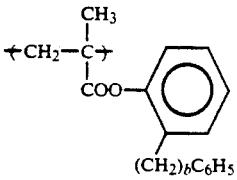
i-3)

-continued

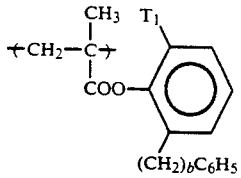
i-4)

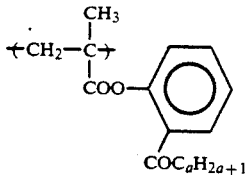
i-5)

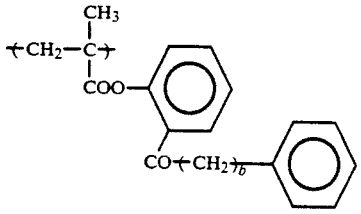
i-6)

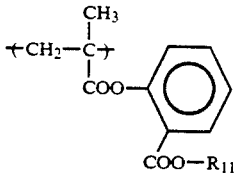
i-7)

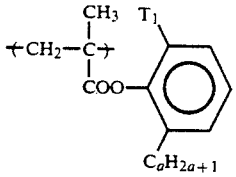
i-8)

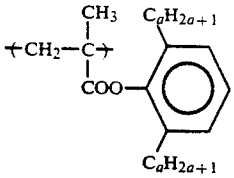
i-9)

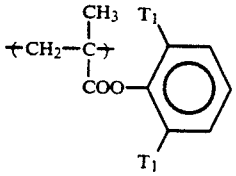
i-10)

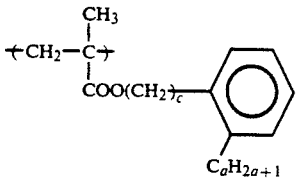
i-11)

-continued i-12)

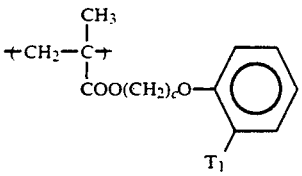

i-13)

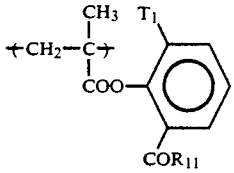

i-14)

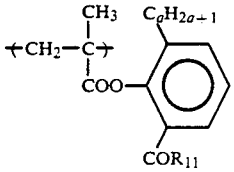

i-15)

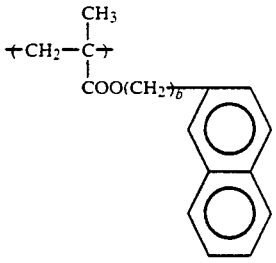

i-16)

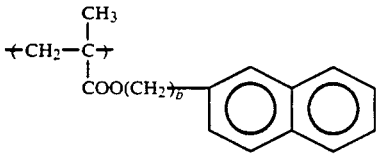

i-17)

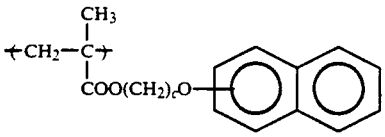

i-18)

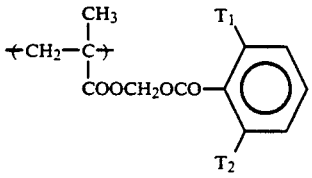

i-19)

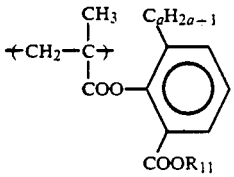

-continued i-20)

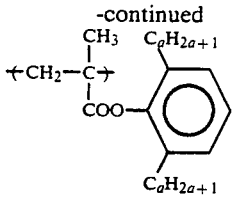

As a copolymerizable component containing the acidic group contained in the resin (A) used in the present invention, any vinyl compound having the acidic group capable of copolymerizable with a polymerizable monomer corresponding to the repeating unit represented by the general formula (I) (including the repeating unit represented by the general formula (IIa) or (IIb)) may be used.

For example, such vinyl compounds are described in *Macromolecular Data Handbook* (*Foundation*), edited by Kobunshi Gakkai, Baifukan (1986). Specific examples of the vinyl compound are acrylic acid, α- and/or β-substituted acrylic acid (e.g., α-acetoxy compound, α-acetoxymethyl compound, α-(2-amino)ethyl compound, α-chloro compound, α-bromo compound, α-fluoro compound, α-tributylsilyl compound, α-cyano compound, β-chloro compound, β-bromo compound, α-chloro-β-methoxy compound, and α,β-dichloro compound), methacrylic acid, itaconic acid, itaconic acid half esters, itaconic acid half amides, crotonic acid, 2-alkenylcarboxylic acids (e.g., 2-pentenoic acid, 2-methyl-2-hexenoic acid, 2-octenoic acid, 4-methyl-2-hexenoic acid, and 4-ethyl-2-octenoic acid), maleic acid, maleic acid half esters, maleic acid half amides, vinylbenzenecarboxylic acid, vinylbenzenesulfonic acid, vinylsulfonic acid, vinylphosphonic acid, vinyl or allyl half ester derivatives of dicarboxylic acids, and ester derivatives or amide derivatives of these carboxylic acids or sulfonic acids having the acidic group in the substituent thereof.

In the

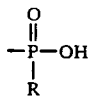

group as an acidic group, R represents a hydrocarbon group or a —OR′ group (wherein R′ represents a hydrocarbon group), and, preferably, R and R′ each represents an aliphatic group having from 1 to 22 carbon atoms which may be substituted (e.g., methyl, ethyl, propyl, butyl, hexyl, octyl, decyl, dodecyl, octadecyl, 2-chloroethyl, 2-methoxyethyl, 3-ethoxypropyl, allyl, crotonyl, butenyl, cyclohexyl, benzyl, phenethyl, 3-phenylpropyl, methylbenzyl, chlorobenzyl, fluorobenzyl, and methoxybenzyl) and an aryl group which may be substituted (e.g., phenyl, tolyl, ethylphenyl, propylphenyl, chlorophenyl, fluorophenyl, bromophenyl, chloromethylphenyl, dichlorophenyl, methoxyphenyl, cyanophenyl, acetamidophenyl, acetylphenyl, and butoxyphenyl).

The cyclic acid anhydride-containing group is a group containing at least one cyclic acid anhydride. The cyclic acid anhydride to be contained includes an aliphatic dicarboxylic acid anhydride and an aromatic dicarboxylic acid anhydride.

Specific examples of the aliphatic dicarboxylic acid anhydrides include succinic anhydride ring, glutaconic anhydride ring, maleic anhydride ring, cyclopentane-1,2-dicarboxylic acid anhydride ring, cyclohexane-1,2-dicarboxylic acid anhydride ring, cyclohexene-1,2-dicarboxylic acid anhydride ring, and 2,3-bicyclo[2,2,-2]octanedicarboxylic acid anhydride. These rings may be substituted with, for example, a halogen atom (e.g., chlorine and bromine) and an alkyl group (e.g., methyl, ethyl, butyl, and hexyl).

Specific examples of the aromatic dicarboxylic acid anhydrides include phthalic anhydride ring, naphtnalenedicarboxylic acid anhydride ring, pyridinedicarboxylic acid anhydride ring and thiophenedicarboxyic acid anhydride ring. These rings may be substituted with, for example, a halogen atom (e.g., chlorine and bromine), an alkyl group (e.g., methyl, ethyl, propyl, and butyl), a hydroxyl group, a cyano group, a nitro group, and an alkoxycarbonyl group (e.g., methoxycarbonyl and ethoxycarbonyl).

Specific examples of the copolymer components having the acidic group are illustrated below, but the present invention should not be construed as being limited thereto.

In the following formulae, $P_1$ represents H or $CH_3$; $P_2$ represents H, $CH_3$, or $CH_2COOCH_3$; $R_{12}$ represents an alkyl group having from 1 to 4 carbon atoms; $R_{13}$ represents an alkyl group having from 1 to 6 carbon atoms, a benzyl group, or a phenyl group; c represents an integer of from 1 to 3; d represents an integer of from 2 to 11; e represents an integer of from 1 to 11; f represents an integer of from 2 to 4; and g represents an integer of from 2 to 10.

ii-1)

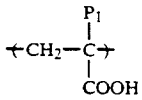

ii-2)

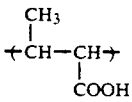

ii-3)

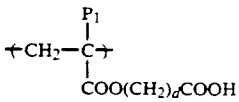

ii-4)

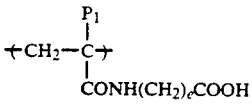

ii-5)

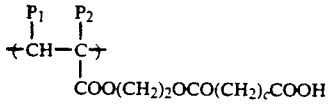

ii-6)

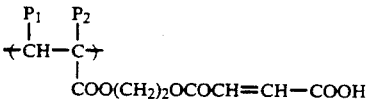

ii-7)

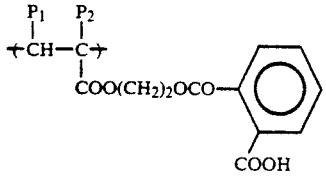

-continued ii-8)

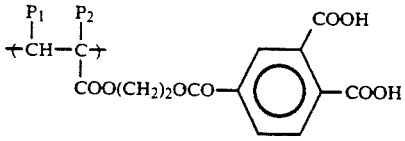

ii-9)

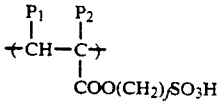

ii-10)

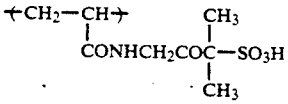

ii-11)

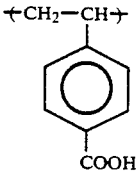

ii-12)

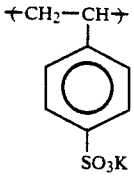

ii-13)

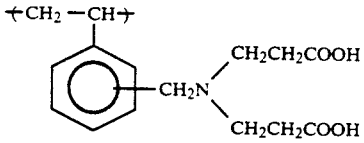

ii-14)

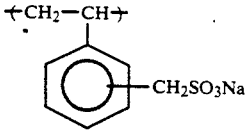

ii-15)

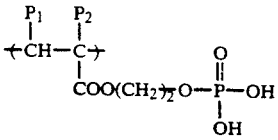

ii-16)

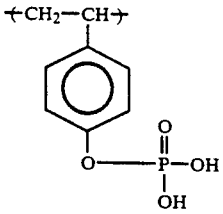

ii-17)

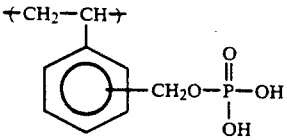

-continued
ii-18)
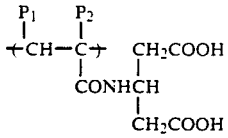
ii-19)
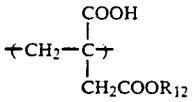
ii-20)
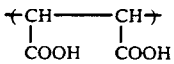
ii-21)
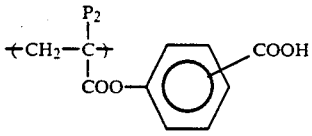
ii-22)
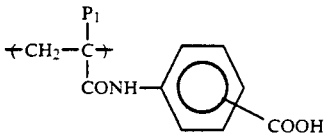
ii-23)
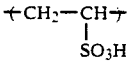
ii-24)
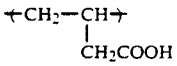
ii-25)
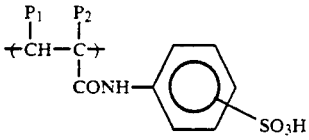
ii-26)
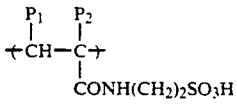
ii-27)
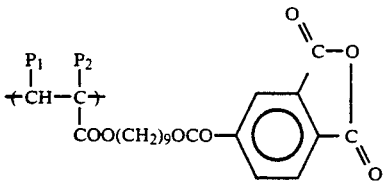
ii-28)
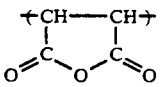
ii-29)
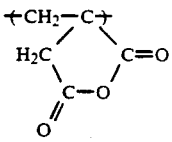
-continued
ii-30)
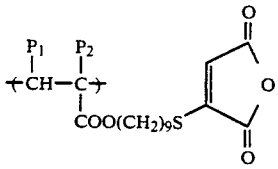
ii-31)
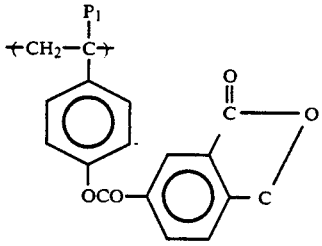
ii-32)
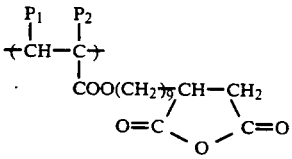
ii-33)
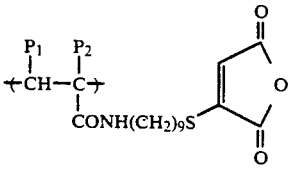
ii-34)
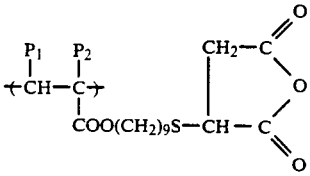
ii-35)
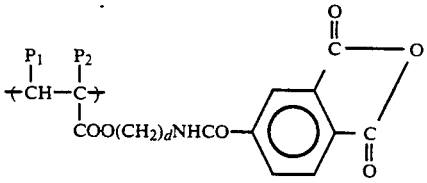
ii-36)
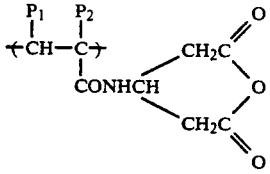
ii-37)
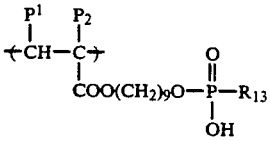
ii-38)
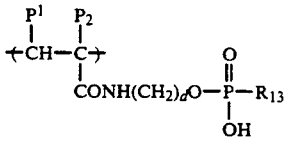

In the resin (A), the above-described acidic group contained in the copolymer component of the polymer may be the same as or different from the acidic group bonded to the terminal of the polymer main chain.

The acidic group which is bonded to one of the terminals of the polymer main chain in the resin (A) according to the present invention includes

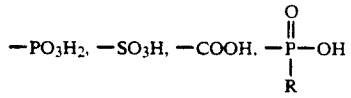

(wherein R is as defined above), and a cyclic acid anhydride-containing group.

The above-described acidic group may be bonded to one of the polymer main chain terminals either directly or via an appropriate linking group.

The linking group can be any group for connecting the acidic group to the polymer main chain terminal. Specific examples of suitable linking group include

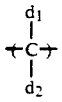

(wherein $d_1$ and $d_2$, which may be the same or different, each represents a hydrogen atom, a halogen atom (e.g., chlorine, and bromine), a hydroxyl group, a cyano group, an alkyl group (e.g., methyl, ethyl, 2-chloroethyl, 2-hydroxyethyl, propyl, butyl, and hexyl), an aralkyl group (e.g., benzyl, and phenethyl), an aryl group (e.g., phenyl)),

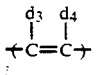

(wherein $d_3$ and $d_4$ each has the same meaning as defined for $d_1$ or $d_2$ above),

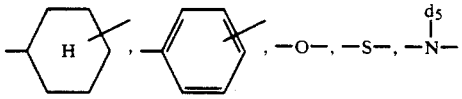

(wherein $d_5$ represents a hydrogen atom or a hydrocarbon group preferably having from 1 to 12 carbon atoms (e.g., methyl, ethyl, propyl, butyl, hexyl, octyl, decyl, dodecyl, 2-methoxyethyl, 2-chloroethyl, 2-cyanoethyl, benzyl, methylbenzyl, chlorobenzyl, methoxybenzyl, phenethyl, phenyl, tolyl, chlorophenyl, methoxyphenyl, and butylphenyl), —CO—, —COO—, —OCO—,

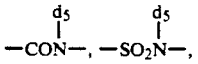

—$SO_2$—, —NHCONH—, —NHCOO—, —$NHSO_2$—, —CONHCOO—, —CONHCONH—, a heterocyclic ring (preferably a 5-membered or 6-membered ring containing at least one of an oxygen atom, a sulfur atom and a nitrogen atom as a hetero atom or a condensed ring thereof (e.g., thiophene, pyridine, furan, imidazole, piperidine, and morpholine)),

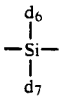

(wherein $d_6$ and $d_7$, which may be the same or different, each represents a hydrocarbon group or —$Od_8$ (wherein $d_8$ represents a hydrocarbon group)), and a combination thereof. Suitable examples of the hydrocarbon group represented by $d_6$, $d_7$ or $d_8$ include those described for $d_5$.

Moreover, the resin (A) preferably contains from 1 to 20% by weight of a copolymer component having a heat- and/or photo-curable functional group in addition to the copolymer component represented by the general formula (I) (including that represented by the general formula (IIa) or (IIb)) and the copolymer component having the acidic group described above, in view of achieving higher mechanical strength.

The term "heat- and/or photo-curable functional group" as used herein means a functional group capable of inducing curing reaction of a resin on application of at least one of heat and light.

Specific examples of the photo-curable functional group include those used in conventional photosensitive resins known as photocurable resins as described, for example, in Hideo Inui and Gentaro Nagamatsu, *Kankosei Kobunshi,* Kodansha (1977), Takahiro Tsunoda, *Shin-Kankosei Jushi,* Insatsu Gakkai Shuppanbu (1981), G. E. Green and B. P. Strak, *J. Macro. Sci. Reas. Macro. Chem.,* C 21 (2), pp. 187 to 273 (1981-82), and C. G. Rattey, *Photopolymerization of Surface Coatings,* A. Wiley Interscience Pub. (1982).

The heat-curable functional group which can be used includes functional groups excluding the above-specified acidic groups. Examples of the heat-curable functional groups are described, for example, in Tsuyoshi Endo, *Netsukokasei Kobunshi no Seimitsuka,* C. M. C. (1986), Yuji Harasaki, *Saishin Binder Gijutsu Binran,* Chapter II-I, Sogo Gijutsu Center (1985), Takayuki Ohtsu, *Acryl Jushi no Gosei Sekkei to Shin-Yotokaihatsu,* Chubu Kei-ei Kaihatsu Center Shuppanbu (1985), and Eizo Ohmori, *Kinosei Acryl Kei Jushi,* Techno System (1985).

Specific examples of the heat-curable functional group which can used include —OH, —SH, —$NH_2$, —$NHR_3$ (wherein $R_3$ represents a hydrocarbon group, for example, an alkyl group having from 1 to 10 carbon atoms which may be substituted (e.g., methyl, ethyl, propyl, butyl, hexyl, octyl, decyl, 2-chloroethyl, 2-methoxyethyl, and 2-cyanoethyl), a cycloalkyl group having from 4 to 8 carbon atoms which may be substituted (e.g., cycloheptyl and cyclohexyl), an aralkyl group having from 7 to 12 carbon atoms which may be substituted (e.g., benzyl, phenethyl, 3-phenylpropyl, chlorobenzyl, methylbenzyl, and methoxybenzyl), and an aryl group which may be substituted (e.g., phenyl, tolyl, xylyl, chlorophenyl, bromophenyl, methoxyphenyl, and naphthyl)),

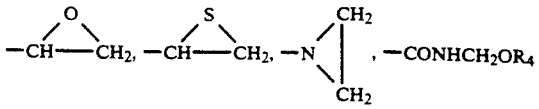

(wherein $R_4$ represents a hydrogen atom or an alkyl group having from 1 to 8 carbon atoms (e.g., methyl, ethyl, propyl, butyl, hexyl, and octyl)). —N=C=O and

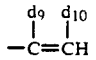

(wherein $d_9$ and $d_{10}$ each represents a hydrogen atom, a halogen atom (e.g., chlorine and bromine) or an alkyl group having from 1 to 4 carbon atoms (e.g., methyl and ethyl)).

Other examples of the functional group include polymerizable double bond groups, for example,

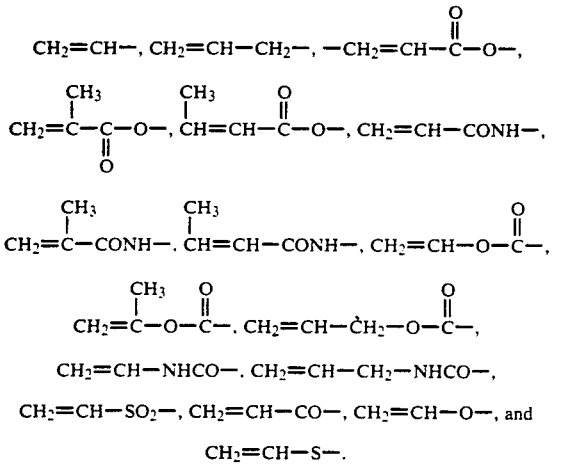

In order to introduce at least one functional group selected from the curable functional groups into the binder resin according to the present invention, a method comprising introducing the functional group into a polymer by macromolecular reaction or a method comprising copolymerizing at least one monomer containing at least one of the functional groups with a monomer corresponding to the repeating unit of the general formula (I) (including that of the general formula (IIa) or (IIb)) and a monomer corresponding to the acidic group-containing polymerizable component can be employed.

The above-described macromolecular reaction can be carried out by using conventionally known low molecular synthesis reactions. For the details, reference can be made, for example, to Nippon Kagakukai (ed.), *Shin-Jikken Kaqaku Koza,* Vol. 14, "Yuki Kagobutsu no Gosei to Hanno (I) to (V)", Maruzen Co., and Yoshio Iwakura and Keisuke Kurita, *Hannosei Kobunshi,* and literature references cited therein.

Suitable examples of the monomers containing the functional group capable of inducing heat- and/or photocurable reaction include vinyl compounds which are copolymerizable with the monomers corresponding to the repeating unit of the general formula (I) and contain the above-described functional group. More specifically, compounds similar to those described in detail above as the acidic group-containing components which contain the above-described functional group in their substituents are illustrated.

Specific examples of the heat- and/or photocurable functional group-containing repeating unit are described below, but the present invention should not be construed as being limited thereto. In the following formulae, $R_{11}$, a, d and e each has the same meaning as defined above; $P_1$ and $P_3$ each represents —H or —$CH_3$; $R_{14}$ represents —CH=$CH_2$ or —$CH_2$CH=$CH_2$; $R_{15}$ represents —CH=$CH_2$,

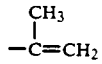

or —CH=$CHCH_3$; $R_{16}$ represents —CH=$CH_2$, —$CH_2$CH=$CH_2$,

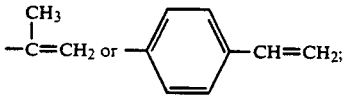

Z represents S or O; $T_3$ represents —OH or —$NH_2$; h represents an integer of from 1 to 11; i represents an integer of from 1 to 10.

iii-1)

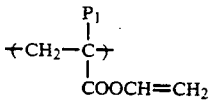

iii-2)

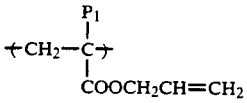

iii-3)

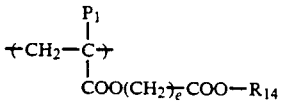

iii-4)

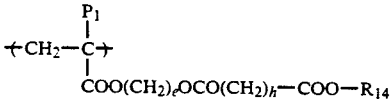

iii-5)

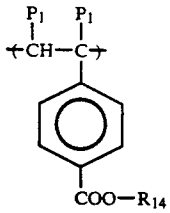

iii-6)

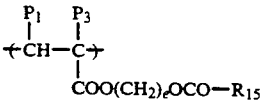

iii-7)

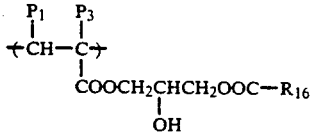

iii-8)

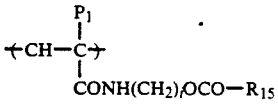

-continued iii-9)

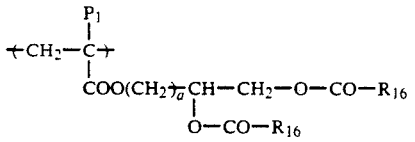

iii-10)

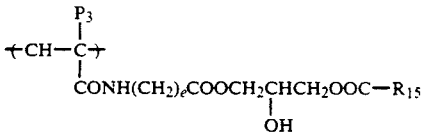

iii-11)

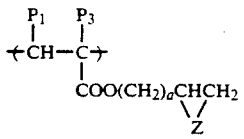

iii-12)

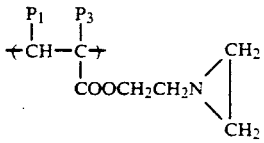

iii-13)

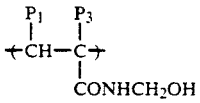

iii-14)

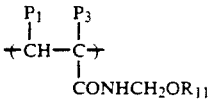

iii-15)

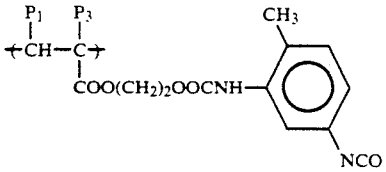

iii-16)

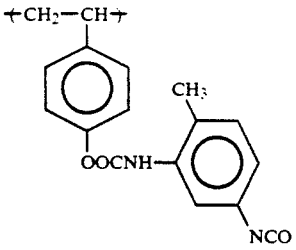

iii-17)

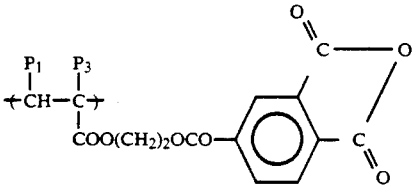

iii-18)

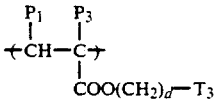

-continued iii-19)

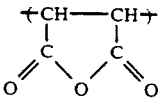

iii-20)

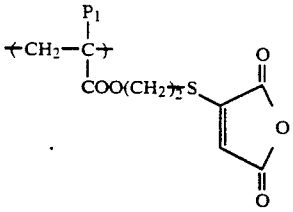

The resin (A) according to the present invention may further be formed of other copolymerizable monomers as copolymerizable components in addition to the monomer corresponding to the repeating unit of the general formula (I) (including that of the general formula (IIa) or (IIb)) and the monomer containing the acidic group. Examples of such monomers include, in addition to methacrylic acid esters, acrylic acid esters and crotonic acid esters containing substituents other than those described for the general formula (I), $\alpha$-olefins, vinyl or allyl esters of alkanoic acids (including, e.g., acetic acid, propionic acid, butyric acid, and valeric acid, as examples of the alkanoic acids), acrylonitrile, methacrylonitrile, vinyl ethers, itaconic acid esters (e.g., dimethyl ester, and diethyl ester), acrylamides, methacrylamides, styrenes (e.g., styrene, vinyltoluene, chlorostyrene, hydroxystyrene, N,N-dimethylaminomethylstyrene, methoxycarbonylstyrene, methanesulfonyloxystyrene, and vinylnaphthalene), and heterocyclic vinyl compounds (e.g., vinylpyrrolidone, vinylpyridine, vinylimidazole, vinylthiophene, vinylimidazoline, vinylpyrazoles, vinyldioxane, vinylquinoline, vinyltetrazole, and vinyloxazine).

The resin (A) according to the present invention, in which the specific acidic group is bonded to only one terminal of the polymer main chain, can easily be prepared by an ion polymerization process, in which a various kind of reagents are reacted at the terminal of a living polymer obtained by conventionally known anion polymerization or cation polymerization; a radical polymerization process, in which radical polymerization is performed in the presence of a polymerization initiator and/or a chain transfer agent which contains the specific acidic group in the molecule thereof; or a process, in which a polymer having a reactive group (for example, an amino group, a halogen atom, an epoxy group, and an acid halide group) at the terminal obtained by the above-described ion polymerization or radical polymerization is subjected to a macromolecular reaction to convert the terminal reactive group into the specific acidic group.

More specifically, reference can be made to, e.g., P. Dreyfuss and R. P. Quirk, *Encycl. Polym. Sci. Eng.*, 7, 551 (1987), Yoshiki Nakajo and Yuya Yamashita, *Senryo to Yakuhin*, 30, 232 (1985), Akira Ueda and Susumu Nagai, *Kagaku to Kogyo*, 60, 57 (1986) and literature references cited therein.

Specific examples of chain transfer agents which can be used include mercapto compounds containing the acidic group or the reactive group capable of being converted into the acidic group (e.g., thioglycolic acid, thiomalic acid, thiosalicyclic acid, 2-mercaptopropionic acid, 3-mercaptopropionic acid, 3-mercaptobutyric acid, N-(2-mercaptopropionyl)glycine, 2-mercaptonicotinic acid, 3-[N-(2-mercaptoethyl)carbamoyl]propionic acid, 3-[N-(2-mercaptoethyl)amino]propionic acid, N-(3-mercaptopropionyl)alanine, 2-mercaptoethanesulfonic acid, 3-mercaptopropanesulfonic acid, 4-mecaptobutanesulfonic acid, 2-mercaptoethanol, 1-mercapto-2-propanol, 3-mercapto-2-butanol, mercaptophenol, 2-mercaptoethylamine, 2-mercaptoimidazole, 2-mercapto-3-pyridinol, 4-(2-mercaptoethyloxycarbonyl)phthalic anhydride, 2-mercaptoethylphosphonic acid, and monomethyl 2-mercaptoethylphosphonate), and alkyl iodide compounds containing the acidic group or acidic group-forming reactive group (e.g., iodoacetic acid, iodopropionic acid, 2-iodoethanol, 2-iodoethanesulfonic acid, and 3-iodopropanesulfonic acid). Of these compounds, mercapto compounds are preferred.

Specific examples of the polymerization initiators containing the acidic group or reactive group include 4,4'-azobis(4-cyanovaleric acid), 4,4'-azobis(4-cyanovaleric acid chloride), 2,2'-azobis(2-cyanopropanol), 2,2'-azobis(2-cyanopentanol), 2,2'-azobis[2-methyl-N-(2-hydroxyethyl)propionamide], 2,2'-azobis{2-methyl-N-[1,1-bis(hydroxymethyl)-2-hydroxyethyl]propionamide}, 2,2'-azobis{2-[1-(2-hydroxyethyl)-2-imidazolin-2-yl]propane}, 2,2'-azobis[2-(2-imidazolin-2-yl)-propane], and 2,2'-azobis[2-(4,5,6,7-tetrahydro-1H-1,3-diazepin-2-yl)propane].

The chain transfer agent or polymerization initiator is usually used in an amount of from 0.5 to 15 parts by weight, preferably from 2 to 10 parts by weight, per 100 parts by weight of the total monomers.

Now, the resin (B) used in the present invention will be described in greater detail below.

The resin (B) is a resin containing at least one recurring unit represented by the general formula (III), having a partially crosslinked structure, and having a weight average molecular weight of $5\times10^4$ or more, and preferably from $8\times10^4$ to $6\times10^5$.

The resin (B) preferably has a glass transition point ranging from 0° C. to 120° C., and more preferably from 10° C. to 95° C.

If the weight average molecular weight of the resin (B) is less than $5\times10^4$, the effect of improving film strength is insufficient. If it exceeds the above-described preferred upper limit, on the other hand, the resin (B) has no substantial solubility in organic solvents and thus may not be practically used.

The resin (B) is a polymer satisfying the above-described physical properties with a part thereof being crosslinked, and including a homopolymer formed of the repeating unit represented by the general formula (III) or a copolymer comprising the repeating unit of the general formula (III) and other monomer copolymerizable with the monomer corresponding to the repeating unit of the general formula (III).

In the repeating unit of the general formula (III), the hydrocarbon groups may be substituted.

X in the general formula (III) preferably represents —COO—, —OCO—, —$CH_2$OCO—, —$CH_2$COO—, or —O—, and more preferably —COO—, —$CH_2$COO—, or —O—.

$R_{21}$ in the general formula (III) preferably represents a substituted or unsubstituted hydrocarbon group having from 1 to 18 carbon atoms. The substituent may be any of substituents other than the above-described polar groups which may be bonded to the one terminal of the polymer main chain. Examples of such substituents include a halogen atom (e.g., fluorine, chlorine, and bromine), —O—$Z_2$, —COO—$Z_2$, and —OCO—$Z_2$, wherein $Z_2$ represents an alkyl group having from 6 to 22 carbon atoms (e.g., hexyl, octyl, decyl, dodecyl, hexadecyl, and octadecyl). Specific examples of preferred hydrocarbon groups are a substituted or unsubstituted alkyl group having from 1 to 18 carbon atoms (e.g., methyl, ethyl, propyl, butyl, pentyl, hexyl heptyl, octyl, decyl, dodecyl, hexadecyl, octadecyl, 2-chloroethyl, 2-bromoethyl, 2-cyanoethyl, 2-methoxycarbonylethyl, 2-methoxyethyl, and 3-bromopropyl), a substituted or unsubstituted alkenyl group having from 4 to 18 carbon atoms (e.g., 2-methyl-1-propenyl, 2-butenyl, 2-pentenyl, 3-methyl-2-pentenyl, 1-pentenyl, 1-hexenyl, 2-hexenyl, and 4-methyl-2-hexenyl), a substituted or unsubstituted aralkyl group having from 7 to 12 carbon atoms (e.g., benzyl, phenethyl, 3-phenylpropyl, naphthylmethyl, 2-naphthylethyl, chlorobenzyl, bromobenzyl, methylbenzyl, ethylbenzyl, methoxybenzyl, dimethylbenzyl, and dimethoxybenzyl), a substituted or unsubstituted alicyclic group having from 5 to 8 carbon atom (e.g., cyclohexyl, 2-cyclohexylethyl, and 2-cyclopentylethyl), and a substituted or unsubstituted aromatic group having from 6 to 12 carbon atoms (e.g., phenyl, naphthyl, tolyl, xylyl, propylphenyl, butylphenyl, octylphenyl, dodecylphenyl, methoxyphenyl, ethoxyphenyl, butoxyphenyl, decyloxyphenyl, chlorophenyl, dichlorophenyl, bromophenyl, cyanophenyl, acetylphenyl, methoxycarbonylphenyl, ethoxycarbonylphenyl, butoxycarbonylphenyl, acetamidophenyl, propionamidophenyl, and dodecyloylamidophenyl).

In the general formula (III), $c_1$ and $c_2$, which may be the same or different, each preferably represents a hydrogen atom, a halogen atom (e.g., fluorine, chlorine, and bromine), a cyano group, an alkyl group having from 1 to 3 carbon atoms, —COO—$Z_1$, —$CH_2$COO—$Z_1$, wherein $Z_1$ preferably represents an aliphatic group having from 1 to 18 carbon atoms. More preferably, $c_1$ and $c_2$, which may be the same or different, each represents a hydrogen atom, an alkyl group having from 1 to 3 carbon atoms (e.g., methyl, ethyl, and propyl), —COO—$Z_1$, —$CH_2$COO—$Z_1$, wherein $Z_1$ more preferably represents an alkyl group having from 1 to 18 carbon atoms or an alkenyl group having from 3 to 18 carbon atoms (e.g., methyl, ethyl, propyl, butyl, hexyl, octyl, decyl, dodecyl, tridecyl, tetradecyl, hexadecyl, octadecyl, pentenyl, hexenyl, octenyl, and decenyl). These alkyl or alkenyl groups may be substituted with one or more substituents same as those described with respect to $R_{21}$.

In the production of the resin (B), introduction of a crosslinked structure into the polymer can be achieved by known techniques, for example, a method of conducting polymerization of monomers including the monomer corresponding to the repeating unit of the general formula (III) in the presence of a poly-functional monomer and a method of preparing a polymer containing a crosslinking functional group and conducting a crosslinking reaction through a macromolecular reaction.

From the standpoint of ease and convenience of procedure, that is, considered that there are involved no unfavorable problems such that a long time is required for the reaction, the reaction is not quantitative, or impurities arising from a reaction accelerator are incorporated into the product, it is preferable to synthesize the resin (B) by using a self-crosslinkable functional group: —$CONHCH_2OR_{31}$ (wherein $R_{31}$ represents a hydrogen atom or an alkyl group) or by utilizing crosslinking through polymerization.

Where a polymerizable reactive group is used, it is preferable to copolymerize a monomer containing two or more polymerizable functional groups and the monomer corresponding to the general formula (III) to thereby form a crosslinked structure over polymer chains.

Specific examples of suitable polymerizable functional groups include

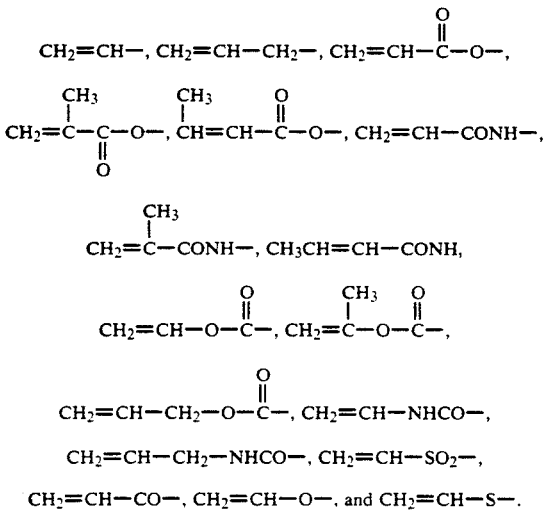

The two or more polymerizable functional groups in the monomer may be the same or different.

Specific examples of the monomer having two or more of the same polymerizable functional groups include styrene derivatives (e.g., divinylbenzene and trivinylbenzene); esters of a polyhydric alcohol (e.g., ethylene glycol, diethylene glycol, triethylene glycol, polyethylene glycol #200, #400 or #600, 1,3-butylene glycol, neopentyl glycol, dipropylene glycol, polypropylene glycol, trimethylolpropane, trimethylolethane, and pentaerythritol) or a polyhydroxyphenol (e.g., hydroquinone, resorcin, catechol, and derivatives thereof) and methacrylic acid, acrylic acid or crotonic acid; vinyl ethers, allyl ethers; vinyl esters, allyl esters, vinylamides or allylamides of a dibasic acid (e.g., malonic acid, succinic acid, glutaric acid, adipic acid, pimelic acid, maleic acid, phthalic acid, and itaconic acid); and condensates of a polyamine (e.g., ethylenediamine, 1,3-propylenediamine, and 1,4-butylenediamine) and a carboxylic acid having a vinyl group (e.g., methacrylic acid, acrylic acid, crotonic acid, and allylacetic acid).

Specific examples of the monomer having two or more different polymerizable functional groups include vinyl-containing ester derivatives or amide derivatives of a vinyl-containing carboxylic acid (e.g., methacrylic acid, acrylic acid, methacryloylacetic acid, acryloylacetic acid, methacryloylpropionic acid, acryloylpropionic acid, itaconyloylacetic acid, itaconyloylpropionic acid, and a reaction product of a carboxylic acid anhydride and an alcohol or an amine (e.g., allyloxycarbonylpropionic acid, allyloxycarbonylacetic acid, 2-allyloxycarbonylbenzoic acid, and allylaminocarbonylpropionic acid)) (e.g., vinyl methacrylate, vinyl acrylate, vinyl itaconate, allyl methacrylate, allyl acrylate, allyl itaconate, vinyl methacryloylacetate, vinyl methacryloylpropionate, allyl methacryloylpropionate, vinyloxycarbonylmethyl methacrylate, vinyloxycarbonylmethyloxycarbonylethyl acrylate, N-allylacrylamide, N-allylmethacrylamide, N-allylitaconic acid amide, and methacryloylpropionic acid allylamide) and condensates of an amino alcohol (e.g., aminoethanol, 1-aminopropanol, 1-aminobutanol, 1-aminohexanol, and 2-aminobutanol) and a vinyl-containing carboxylic acid.

The resin (B) having a partially crosslinked structure can be obtained by polymerization using the above-described monomer having two or more polymerizable functional groups in a proportion of not more than 20% by weight based on the total monomers. It is more preferable for the monomer having two or more polymerizable functional groups to be used in a proportion of not more than 15% by weight in cases where the polar group is introduced into the terminal by using a chain transfer agent hereinafter described, or in a proportion of not more than 5% by weight in other cases.

On the other hand, where the resin (B) contains no polar group at the terminal thereof (i.e., the resin (B) other than the resin (B')), a crosslinked structure may be formed in the resin (B) by using a resin containing a crosslinking functional group which undergoes curing on application of heat and/or light.

Such a crosslinking functional group may be any of those capable of undergoing a chemical reaction between molecules to form a chemical bond. Specifically, a mode of reaction inducing intermolecular bonding by a condensation reaction or addition reaction, or crosslinking by a polymerization reaction upon application of heat and/or light can be utilized.

Examples of the above-described crosslinking functional group include (i) at least one combination of (i-1) a functional group having a dissociative hydrogen atom }e.g., —COOH, —$PO_3H_2$,

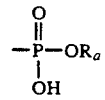

(wherein $R_a$ represents an alkyl group having from 1 to 18 carbon atoms (preferably an alkyl group having from 1 to 6 carbon atoms (e.g., methyl, ethyl, propyl, butyl, and hexyl)), an aralkyl group having from 7 to 11 carbon atoms (e.g., benzyl, phenethyl, methylbenzyl, chlorobenzyl, and methoxybenzyl), an aryl group having from 6 to 12 carbon atoms (e.g., phenyl, tolyl, xylyl, mesityl, chlorophenyl, ethylphenyl, methoxyphenyl, and naphthyl), —$OR_{32}$ (wherein $R_{32}$ has the same meaning as the hydrocarbon group for $R_a$ described above), —OH, —SH, and —$NHR_{33}$ (wherein $R_{33}$ represents a hydrogen atom or an alkyl group having from 1 to 4 carbon atoms, e.g., methyl, ethyl, propyl, and butyl)} and (i-2) a functional group selected from the group consisting of

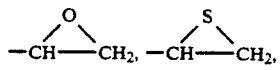

—NCO, and —NCS; and (ii) a group containing —$CONHCH_2OR_{34}$ (wherein $R_{34}$ represents a hydrogen atom or an alkyl group having from 1 to 6 carbon atoms, e.g., methyl, ethyl, propyl, butyl, and hexyl) or a polymerizable double bond group.

Specific examples of the polymerizable double bond group are the same as those described above for the polymerizable functional groups.

Further, specific examples of the functional groups and compounds to be used are described, e.g., in Tsuyoshi Endo, *Netsukokasei Kobunshi no Seimitsuka,* C.M.C. K.K. (1986), Yuji Harasaki, *Saishin Binder Gijutsu Binran,* Ch. II-1, Sogo Gijutsu Center (1985), Takayuki Ohtsu, *Acryl Jushi no Gosei Sekkei to Shin Yoto Kaihatsu,* Chubu Keiei Kaihatsu Center Shuppanbu (1985), Eizo Ohmori, *Kinosei Acryl Jushi,* Techno System (1985), Hideo Inui and Gentaro Nagamatsu, *Kankosei Kobunshi,* Kodansha (1977), Takahiro Kadota, *Shin Kankosei Jushi,* Insatsu Gakkai Shuppanbu (1981), G. E. Green and B. P. Stark, J. *Macro. Sci. Revs. Macro. Chem.,* C21(2), pp. 187–273 (1981–1982), and C. G. Roffey, *Photopolymerization of Surface Coatings,* A. Wiley Interscience Pub. (1982).

These crosslinking functional groups may be present in the same copolymerizable component or separately in different copolymerizable components.

Suitable monomers corresponding to the copolymerizable components containing the crosslinking functional group include vinyl compounds containing such a functional group and being capable of copolymerizable with the monomer corresponding to the general formula (III). Examples of such vinyl compounds are described, e.g., in Kobunshi Gakkai (ed.), *Kobunshi Data Handbook* (*Kiso-hen*), Baifukan (1986). Specific examples of these vinyl monomers include acrylic acid, α- and/or β-substituted acrylic acids (e.g., α-acetoxy, α-acetoxymethyl, α-(2-amino)ethyl, α-chloro, α-bromo, α-fluoro, α-tributylsilyl, α-cyano, β-chloro, β-bromo, α-chloro-β-methoxy, and α,β-dichloro compounds)), methacrylic acid, itaconic acid, itaconic half esters, itaconic half amides, crotonic acid, 2-alkenylcarboxylic acids (e.g., 2-pentenoic acid, 2-methyl-2-hexenoic acid, 2-octenoic acid, 4-methyl-2-hexenoic acid, and 4-ethyl-2-octenoic acid), maleic acid, maleic half esters, maleic half amides, vinylbenzenecarboxylic acid, vinylbenzenesulfonic acid, vinylsulfonic acid, vinylphosphonic acid, vinyl or allyl half ester derivatives of dicarboxylic acids, and ester or amide derivatives of these carboxylic acids or sulfonic acids containing the crosslinking functional group in the substituents thereof.

The proportion of the above-described copolymerizable component containing the crosslinking functional group in the resin (B) preferably ranges from 0.05 to 30% by weight, and more preferably from 0.1 to 20% by weight.

In the preparation of such a resin, a reaction accelerator may be used, if desired, to accelerate a crosslinking reaction. Examples of usable reaction accelerators include acids (e.g., acetic acid, propionic acid, butyric acid, benzenesulfonic acid, and p-toluenesulfonic acid), peroxides, azobis compounds, crosslinking agents, sensitizers, and photopolymerizable monomers. Specific examples of crosslinking agents are described, for example, in Shinzo Yamashita and Tosuke Kaneko (ed.), *Kakyozai Handbook,* Taiseisha (1981), including commonly employed crosslinking agents, such as organosilanes, polyurethanes, and polyisocyanates, and curing agents, such as epoxy resins and melamine resins.

Where the resin contains a photo-crosslinking functional group, compounds described in the literature cited above with respect to photosensitive resins can be used.

The resin (B) may further be formed of, as copolymerizable components, other monomers (e.g., those described above as optional monomers which may be used in forming the resin (A)), in addition to the monomer corresponding to the repeating unit of the general formula (III) and the above-described polyfunctional monomer.

While the resin (B) is characterized by having its partial crosslinked structure as stated above, it is also required to be soluble in an organic solvent used at the preparation of a dispersion for forming a photoconductive layer containing at least an inorganic photoconductive substance and the binder resin. More specifically, it is required that at least 5 parts by weight of the resin (B) be dissolved in 100 parts by weight of toluene at 25° C. Solvents which can be used in the preparation of the dispersion include halogenated hydrocarbons, e.g., dichloromethane, dichloroethane, chloroform, methylchloroform, and triclene; alcohols, e.g., methanol, ethanol, propanol, and butanol; ketones, e.g., acetone, methyl ethyl ketone, and cyclohexanone; ethers, e.g., tetrahydrofuran and dioxane; esters, e.g., methyl acetate, ethyl acetate, propyl acetate, butyl acetate, and methyl propionate; glycol ethers, e.g., ethylene glycol monomethyl ether, and 2-methoxyethylacetate; and aromatic hydrocarbons, e.g., benzene, toluene, xylene, and chlorobenzene. These solvents may be used either individually or as a mixture thereof.

According to a preferred embodiment of the resin (B), the resin (B) is a polymer (the resin (B')) having a weight average molecular weight of $5\times10^4$ or more, and preferably between $8\times10^4$ and $6\times10^5$, containing at least one repeating unit represented by the general formula (III), having a partially crosslinked structure and, in addition, having at least one polar group selected from $-PO_3H_2$, $-SO_3H$, $-COOH$, $-OH$, $-SH$,

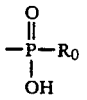

(wherein $R_0$ represents a hydrocarbon group or $-OR_0'$, wherein $R_0'$ represents a hydrocarbon group), a cyclic acid anhydride-containing group, $-CHO$, $-CONH_2$, $-SO_2NH_2$, and

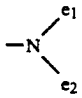

(wherein $e_1$ and $e_2$, which may be the same or different, each represents a hydrogen atom or a hydrocarbon group) bonded to only one terminal of at least one main chain thereof.

The resin (B') preferably has a glass transition point of from 0° C. to 120° C., and more preferably from 10° C. to 95° C.

The —OH group include a hydroxy group of alcohols containing a vinyl group or allyl group (e.g., allyl alcohol), a hydroxy group of (meth)acrylates containing —OH group in an ester substituent thereof, a hydroxy group of (meth)acrylamides containing —OH group in an N-substituent thereof, a hydroxy group of hydroxy-substituted aromatic compounds containing a polymerizable double bond, and a hydroxy group of (meth)acrylic acid esters and amides each having a hydroxyphenyl group as a substituent.

The $—PO_2R_0H—$ and cyclic acid anhydride-containing group each of which is present in the resin (B') are the same as those described with respect to the resin (A) above.

In the polar group

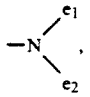

specific examples of $e_1$ and $e_2$ include a hydrogen atom, a substituted or unsubstituted aliphatic group having from 1 to 10 carbon atoms (e.g., methyl, ethyl, propyl, butyl, hexyl, octyl, 2-cyanoethyl, 2-chloroethyl, 2-ethoxycarbonylethyl, benzyl, phenethyl, and chlorobenzyl), and a substituted or unsubstituted aryl group (e.g., phenyl, tolyl, xylyl, chlorophenyl, bromophenyl, methoxycarbonylphenyl, and cyanophenyl).

Of the terminal polar groups in the resin (B'), preferred are $—PO_3H_2$, $—SO_3H$, —COOH, —OH, —SH,

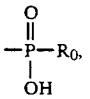

$—CONH_2$, and $—SO_2NH_2$.

In the resin (B'), the specific polar group is bonded to one terminal of the polymer main chain either directly or via an appropriate linking group. The linking group includes a carbon-carbon bond (single bond or double bond), a carbon-hetero atom bond (the hetero atom including e.g., an oxygen atom, a sulfur atom, a nitrogen atom, and a silicon atom), a hetero atom-hetero atom bond, or an appropriate combination thereof. Specific examples of linking group include

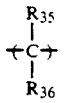

(wherein $R_{35}$ and $R_{36}$ each represents a hydrogen atom, a halogen atom (e.g , fluorine, chlorine, and bromine), a cyano group, a hydroxyl group, an alkyl group (e.g., methyl, ethyl, and propyl)),

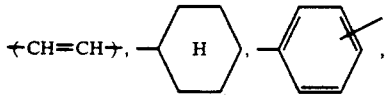

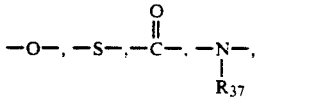

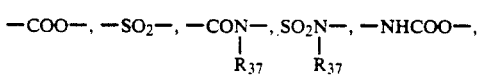

-continued

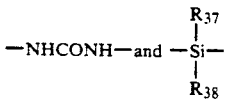

(wherein $R_{37}$ and $R_{38}$ each represents a hydrogen atom or a hydrocarbon group having from 1 to 8 carbon atoms (e.g., methyl, ethyl, propyl, butyl pentyl, hexyl, benzyl, phenethyl, phenyl, and tolyl) or $—OR_{39}$ (wherein $R_{39}$ has the same meaning as the hydrocarbon group of $R_{37}$)).

The resin (B') having the specific polar group bonded to only one terminal of at least one polymer main chain thereof can be easily synthesized by a method comprising reacting various reagents on the terminal of a living polymer obtained by conventional anion polymerization or cation polymerization (ion polymerization method), a method comprising radical polymerization using a polymerization initiator and/or chain transfer agent containing the specific polar group in its molecule (radical polymerization method), or a method comprising once preparing a polymer having a reactive group at the terminal thereof by the above-described ion polymerization method or radical polymerization method and converting the terminal reactive group into the specific polar group by a macromolecular reaction. For details, reference can be made, for example, to P. Dreyfuss and R. P. Quirk *Encycl. Polym. Sci. Eng,* 7, 551 (1987), Yoshiki Nakajo and Yuya Yamashita, *Senryo to Yakuhin,* 30, 232 (1985), and Akira Ueda and Susumu Nagai, *Kagaku to Kogyo,* 60, 57 (1986), and literature references cited therein.

In greater detail, the resin (B') can be prepared by a method in which a mixture of a monomer corresponding to the repeating unit represented by the general formula (III), the above described polyfunctional monomer for forming a crosslinked structure, and a chain transfer agent containing the specific polar group to be introduced to one terminal is polymerized in the presence of a polymerization initiator (e.g., azobis compounds and peroxides), a method using a polymerization initiator containing the specific polar group to be introduced without using the above described chain transfer agent, or a method using a chain transfer agent and a polymerization initiator both of which contain the specific polar group to be introduced. Further, the resin (B') may also be obtained by conducting polymerization using a compound having a functional group, such as an amino group, a halogen atom, an epoxy group, or an acid halide group, as the chain transfer agent or polymerization initiator according to any of the three methods set forth above, followed by reacting such a functional group through a macromolecular reaction to thereby introduce the polar group into the resulting polymer. Suitable examples of chain transfer agents used include mercapto compounds containing the polar group or a substituent capable of being converted to the polar group, e.g., thioglycolic acid, thiomalic acid, thiosalicylic acid, 2-mercaptopropionic acid, 3-mercaptopropionic acid, 3-mercaptobutyric acid, N-(2-mercaptopropionyl)glycine, 2-mercaptonicotinic acid, 3-[N-(2-mercaptoethyl)carbamoyl]propionic acid, 3-[N-mercaptoethyl)amino]propionic acid, N-(3-mercaptopropionyl)alanine, 2-mercaptoethanesulfonic acid, 3-mercaptopropanesulfonic acid, 4-mercaptobutanesulfonic acid, 2-mercaptoethanol, 3-mercapto-1,2-propanediol, 1-mercapto-2-propanol, 3-mercapto-2-butanol, mercaptophenol, 2-mercaptoethylamine, 2-mercaptoimidazole, and 2-mercapto-3-pyridinol; and iodoalkyl compounds containing the polar group or a substituent capable of being converted to the polar group, e.g., iodoacetic acid, iodopropionic acid, 2-iodoethanol, 2-iodoethanesulfonic acid, and 3-iodopropanesulfonic acid. Preferred of them are mercapto compounds.

The chain transfer agent or polymerization initiator is used in an amount of from 0.5 to 15 parts by weight, and preferably from 1 to 10 parts by weight, per 100 pats by weight of the total monomers.

When the resin (A) according to the present invention contains the heat- and/or photo-curable functional group described above, a crosslinking agent may be used together in order to accelerate a crosslinking reaction in the light-sensitive layer. The crosslinking agent which can be used in the present invention include compounds which are usually used as crosslinking agents. Suitable compounds are described, for example, in Shinzo Yamashita and Tosuke Kaneko (ed.), *Crosslinking Agent Handbook,* Taiseisha (1981), and *Macromolecular Data Handbook (Foundation)*, edited by Kobunshi Gakkai, Baifukan (1986).

Specific examples thereof include organic silane series compounds (e.g., silane coupling agents such as vinyltrimethoxysilane, vinyltributoxysilane, γ-glycidoxypropyltrimethoxysilane, γ-mercaptopropyltriethoxysilane, and γ-aminopropyltriethoxysilane), polyisocyanate series compounds (e.g., toluylene diisocyanate, o-toluylene diisocyanate, diphenylmethane diisocyanate, triphenylmethane triisocyanate, polyethylenepolyphenyl isocyanate, hexamethylene diisocyanate, isohorone diisocyanate, and macromolecular polyisocyanate), polyol series compounds (e.g., 1,4-butanediol, polyoxypropylene glycol, polyoxyalkylene glycol, and 1,1,1-trimethylolpropane), polyamine series compounds (e.g., ethylenediamine, γ-hydroxypropylated ethylenediamine, phenylenediamine, hexamethylenediamine, N-aminoethylpiperazine, and modified aliphatic polyamines), polyepoxy group-containing compounds and epoxy resins (e.g., the compounds described, for example, in Hiroshi Kakiuchi, *New Epoxy Resin,* Shokodo (1985) and Kuniyuki Hashimoto *Epoxy Resins,* Nikkan Kogyo Shinbunsha (1969)), melamine resins (e.g., the compounds described, for example, in Ichiro Miwa and Hideo Matsunaga, *Urea-melamine Resins,* Nikkan Kogyo Shinbunsha (1969)), and poly(-meth)acrylate series compounds (e.g., the compounds described, for example, in Shin Ohgawara, Takeo Saegusa, and Toshinobu Higashimura, *Oligomer,* Kodansha (1976), and Eizo Ohmori, *Functional Acrylic Resins, Techno System* (1985) including polyethylene glycol diacrylate, neopentyl glycol diacrylate, 1,6-hexanediol acrylate, trimethylolpropane triacrylate, pentaerythritol polyacrylate, bisphenol A-diglycidyl ether acrylate, oligoester acrylate, and their corresponding methacrylates).

The amount of the crosslinking agent used in the present invention is from 0.5 to 30% by weight, and preferably from 1 to 10% by weight, based on the total amount of the binder resin.

In the present invention, the binder resin may, if desired contain a reaction accelerator for accelerating the crosslinking reaction of the photoconductive layer.

When the crosslinking reaction is that of a reaction type for forming a chemical bond between the functional groups, an organic acid (e.g., acetic acid, propionic acid, butyric acid, benzenesulfonic acid, and p-toluenesulfonic acid) can be used.

When the crosslinking reaction is that of a polymerization reaction type, a polymerization initiator (e.g., a peroxide, and an azobis type compound, preferably an azobis type polymerization initiator) or a monomer having a polyfunctional polymerizable group (e.g., vinyl methacrylate, allyl methacrylate, ethylene glycol diacrylate, polyethylene glycol diacrylate, divinylsuccinic acid esters, divinyladipic acid esters, diallylsuccinic acid esters, 2-methylvinyl methacrylate, and divinylbenzene) can be used.

The coating composition containing the resin (A) which contains the heat- and/or photo-curable functional group described above according to the present invention for forming a photoconductive layer is crosslinked or subjected to thermosetting after coating. For performing crosslinking or thermosetting, a severer drying condition than that used for producing conventional electrophotographic light-sensitive materials is employed. For example, the drying step is carried out at a higher temperature and/or for a longer time. Also, after removing the solvent in the coating composition by drying, the photoconductive layer may be further subjected to a heat treatment, for example, at from 60° to 120° C. for from 5 to 120 minutes. In the case of using the above described reaction accelerator, a milder treatment condition can be employed.

The ratio of the resin (A) (including the resin (A')) to the amount of the resin (B) (including the resin (B')) used in the present invention varies depending on the kind, particle size, and surface conditions of the inorganic photoconductive substance used. In general, however, the weight ratio of the resin (A)/the resin (B) is 5 to 50/95 to 50, preferably 10 to 40/90 to 60.

In addition to the resin (A) (including the resin (A')) and the resin (B) (including the resin (B')), the resin binder according to the present invention may further comprise other resins. Suitable examples of such resins include alkyd resins, polybutyral resins, polyolefins, ethylene-vinyl acetate copolymers, styrene resins, styrene-butadiene resins, acrylate-butadiene resins, and vinyl alkanoate resins.

The proportion of these other resins should not exceed 30% by weight based on the total binder. If the proportion exceeds 30% by weight, the effects of the present invention, particularly the improvement in electrostatic characteristics, would be lost.

The inorganic photoconductive substance which can be used in the present invention includes zinc oxide, titanium oxide, zinc sulfide, cadmium sulfide, cadmium carbonate, zinc selenide, cadmium selenide, tellurium selenide, and lead sulfide, preferably zinc oxide and titanium oxide.

The binder resin is used in a total amount of from 10 to 100 parts by weight, preferably from 15 to 50 parts by weight, per 100 parts by weight of the inorganic photoconductive substance.

The spectral sensitizer used in the present invention includes various kinds of dyes capable of spectrally sensitizing the photoconductive substance in the visible to infrared region. They can be use individually or in a combination of two or more thereof. Examples of the spectral sensitizers are carbonium dyes, diphenylmethane dyes, triphenylmethane dyes, xanthene dyes, phthalein dyes, polymethine dyes (e.g., oxonol dyes, merocyanine dyes, cyanine dyes, rhodacyanine dyes, and styryl dyes), and phthalocyanine dyes (including metallized dyes). Reference can be made to, for example, in Harumi Miyamoto and Hidehiko Takei, *Imaging*, 1973, No. 8, 12, C. J. Young et al., *RCA Review*, 15, 469 (1954), Kohei Kiyota et al., *Denkitsushin Gakkai Ronbunshi, J 63-C*, No. 2, 97 (1980), Yuji Harasaki et al., *Kogyo Kagaku Zasshi*, 66, 78 and 188 (1963), and Tadaaki Tani, *Nihon Shashin Gakkaishi*, 35, 208 (1972).

Specific examples of the carbonium dyes, triphenylmethane dyes, xanthene dyes, and phthalein dyes are described, for example, in JP-B-51-452, JP-A-50-90334, JP-A-50-114227, JP-A-53-39130, JP-A-53-82353, U.S. Pat. Nos. 3,052,540 and 4,054,450, and JP-A-57-16456.

The polymethine dyes such as oxonol dyes, merocyanine dyes, cyanine dyes and rhodacyanine dyes include those described, for example, in F. M. Hamer, *The Cyanine Dyes and Related Compounds*. Specific examples include those described, for example, in U.S. Pat. Nos. 3,047,384, 3,110,591, 3,121,008, 3,125,447, 3,128,179, 3,132,942, and 3,622,317, British Patents 1,226,892, 1,309,274 and 1,405,898, JP-B-48-7814 and JP-B-55-18892.

In addition, polymethine dyes capable of spectrally sensitizing in the longer wavelength region of 700 nm or more, i.e., from the near infrared region to the infrared region, include those described, for example, in JP-A-47-840, JP-A-47-44180, JP-B-51-41061, JP-A-49-5034, JP-A-49-45122, JP-A-57-46245, JP-A-56-35141, JP-A-57-157254, JP-A-61-26044, JP-A-61-27551, U.S. Pat. Nos. 3,619,154 and 4,175,956, and *Research Disclosure*, 216, 117 to 118 (1982).

The light-sensitive material of the present invention is particularly excellent in that the performance properties are not liable to vary even when combined with various kinds of sensitizing dyes.

If desired, the photoconductive layer may further contain various additives commonly employed in conventional electrophotographic light-sensitive layer, such as chemical sensitizers. Examples of such additives include electron-accepting compounds (e.g., halogen, benzoquinone, chloranil, acid anhydrides, and organic carboxylic acids) as described in the above-mentioned *Imaging*, 1973, No. 8, 12; and polyarylalkane compounds, hindered phenol compounds, and p-phenylenediamine compounds as described in Hiroshi Kokado et al., *Saikin-no Kododen Zairyo to Kankotai no Kaihatsu Jitsuyoka*, Chaps. 4 to 6, Nippon Kagaku Joho K. K. (1986).

The amount of these additives is not particularly restricted and usually ranges from 0.0001 to 2.0 parts by weight per 100 parts by weight of the photoconductive substance.

The photoconductive layer suitably has a thickness of from 1 to 100 μm, preferably from 10 to 50 μm.

In cases where the photoconductive layer functions as a charge generating layer in a laminated light-sensitive material composed of a charge generating layer and a charge transporting layer, the thickness of the charge generating layer suitably ranges from 0.01 to 1 μm, particularly from 0.05 to 0.5 μm.

If desired, an insulating layer can be provided on the light-sensitive layer of the present invention. When the insulating layer is made to serve for the main purposes for protection and improvement of durability and dark decay characteristics of the light-sensitive material, its thickness is relatively small. When the insulating layer is formed to provide the light-sensitive material suitable for application to special electrophotographic processes, its thickness is relatively large, usually ranging from 5 to 70 μm, particularly from 10 to 50 μm.

Charge transporting material in the above-described laminated light-sensitive material include polyvinylcarbazole, oxazole dyes, pyrazoline dyes, and triphenylmethane dyes. The thickness of the charge transporting layer ranges from 5 to 40 μm, preferably from 10 to 30 μm.

Resins to be used in the insulating layer or charge transporting layer typically include thermoplastic and thermosetting resins, e.g., polystyrene resins, polyester resins, cellulose resins, polyether resins, vinyl chloride resins, vinyl acetate resins, vinyl chloride-vinyl acetate copolymer resins, polyacrylic resins, polyolefin resins, urethane resins, epoxy resins, melamine resins, and silicone resins.

The photoconductive layer according to the present invention can be provided on any known support. In general, a support for an electrophotographic light-sensitive layer is preferably electrically conductive. Any of conventionally employed conductive supports may be utilized in the present invention. Examples of usable conductive supports include a substrate (e.g., a metal sheet, paper, and a plastic sheet) having been rendered electrically conductive by, for example, impregnating with a low resistant substance; the above-described substrate with the back side thereof (opposite to the light-sensitive layer side) being rendered conductive and having further coated thereon at least one layer for the purpose of prevention of curling; the above-described substrate having provided thereon a water-resistant adhesive layer; the above-described substrate having provided thereon at least one precoat layer; and paper laminated with a conductive plastic film on which aluminum is vapor deposited.

Specific examples of conductive supports and materials for imparting conductivity are described, for example, in Yukio Sakamoto, *Denshishashin*, 14, No. 1, 2 to 11 (1975), Hiroyuki Moriga, *Nyumon Tokushushi no Kagaku*, Kobunshi Kankokai (1975), and M. F. Hoover, *J, Macromol. Sci. Chem.*, A-4(6), 1327 to 1417 (1970).

In accordance with the present invention, an electrophotographic light-sensitive material which exhibits improved electrostatic charging characteristics and pre-exposure fatigue resistance can be obtained. Also, an electrophotographic lithographic printing plate precursor which provides clear prints of good image property can be obtained.

Moreover, the electrophotographic characteristics are more improved when the specific methacrylate component represented by the general formula (IIa) or (IIb) is employed as a copolymerizable component in the resin (A).

When the resin (B') having the specific polar group at the terminal of the main chain is employed, the electrostatic characteristics, particularly, DRR and $E_{1/10}$ are further improved, and these preferred characteristics are almost maintained in the case of greatly changing the environmental conditions from high temperature and high humidity to low temperature and low humidity.

The present invention will now be illustrated in greater detail with reference to the following examples, but it should be understood that the present invention is not to be construed as being limited thereto.

SYNTHESIS EXAMPLE

Synthesis of Resin (A-1)

A mixed solution of 98 g of benzyl methacrylate, 2 g of acrylic acid, 3 g of thiosalicylic acid, and 200 g of toluene was heated to 70° C. under nitrogen gas stream.

Then, after adding 1.0 g of 2,2'-azobisisobutyronitrile (hereinafter simply referred to as AIBN) to the above mixture, the reaction was carried out for 4 hours. Then, after adding thereto 0.4 g of AIBN, the mixture was stirred for 2 hours and, after further adding thereto 0.2 g of AIBN, the mixture was stirred for 3 hours. The weight average molecular weight (Mw) of the resulting copolymer (A-1) was $6.5\times10^3$.

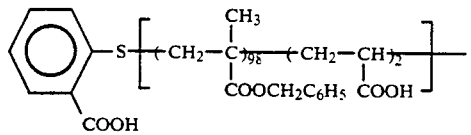

(A-1)

SYNTHESIS EXAMPLES A-2 TO A-16

Synthesis of Resins (A-2) to (A-16)

Each of resins (A) shown in Table 1 was synthesized by following the same procedure as Synthesis Example A-1 except that each of the monomers shown in Table 1 below was used in place of 98 g of benzyl methacrylate and 2 g of acrylic acid. The weight average molecular weight of each of the resins obtained was in a range from $6\times10^3$ to $8\times10^3$.

TABLE 1

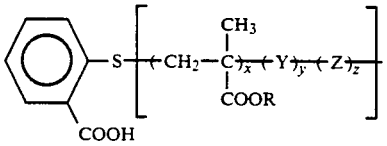

| Synthesis Example No. | Resin (A) | R | —Y— | —Z— | x/y/z (weight ratio) |
|---|---|---|---|---|---|
| 2 | A-2 | $-C_2H_5$ | — | $-CH_2-C(CH_3)(COOH)-$ | 97/0/3.0 |
| 3 | A-3 | $-C_3H_7$ | — | $-CH_2-C(CH_3)(COOH)-$ | 96.5/0/3.5 |
| 4 | A-4 | $-CH_2C_6H_5$ | — | $-CH(CH_3)-CH(COOH)-$ | 98/0/2.0 |
| 5 | A-5 | $-CH_2C_6H_5$ | $-CH_2-CH(COOCH_3)-$ | $-CH_2-C(COOH)(CH_2COOH)-$ | 89/10/1.0 |
| 6 | A-6 | $-CH_3$ | $-CH_2-CH(COOC_2H_5)-$ | $-CH_2-CH(COO(CH_2)_2COOH)-$ | 82/15/3.0 |
| 7 | A-7 | $-C_6H_5$ | — | $-CH_2-CH(COOH)-$ | 98.5/0/1.5 |
| 8 | A-8 | 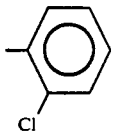 | — | " | 98/0/2.0 |

TABLE 1-continued
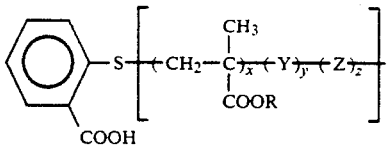
| Synthesis Example No. | Resin (A) | R | —Y— | —Z— | x/y/z (weight ratio) |
|---|---|---|---|---|---|
| 9 | A-9 | 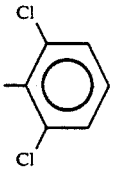 | — | 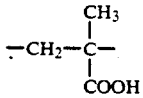 | 97/0/3.0 |
| 10 | A-10 | 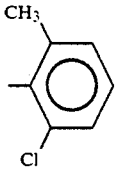 | — | 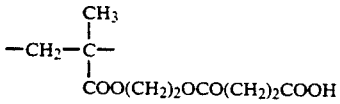 | 95/0/5.0 |
| 11 | A-11 | 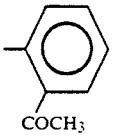 | — | 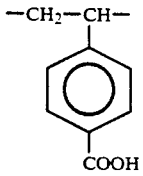 | 96/0/4.0 |
| 12 | A-12 | 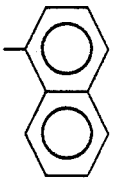 | 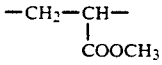 | 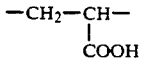 | 82.5/15/2.5 |
| 13 | A-13 | 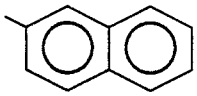 | — | 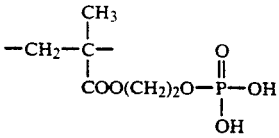 | 99/0/1.0 |
| 14 | A-14 | 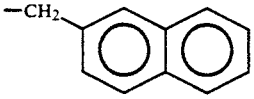 | — | 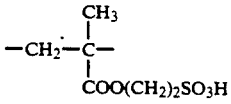 | 99.2/0/0.8 |
| 15 | A-15 | $-CH_2C_6H_5$ | — | 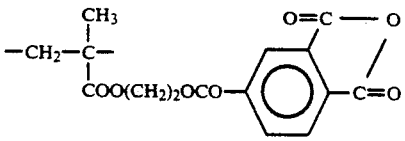 | 94/0/6.0 |
| 16 | A-16 | $-C_4H_9$ | 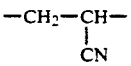 | 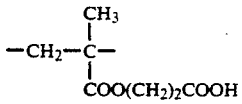 | 92/5/3.0 |

SYNTHESIS EXAMPLES A-17 TO A-27

Synthesis of Resins (A-17) to (A-27)

Each of resins (A) shown in Table 2 was synthesized by following the same procedure as Synthesis Example A-1 except that each of the methacrylates and each of the mercapto compounds shown in Table 2 below were used in place of 98 g of benzyl methacrylate and 3 g of thiosalicylic acid, and that 150 g of toluene and 50 g of isopropanol were used in place of 200 g of toluene.

TABLE 2

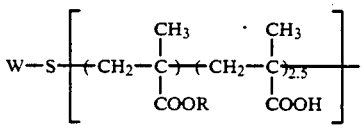

| Synthesis Example No. | Resin (A) | Mercapto Compound (W—) | | R— | | Weight Average Molecular Weight |
|---|---|---|---|---|---|---|
| 17 | A-17 | $HOOCCH_2CH_2CH_2$— | 4 g | —$C_2H_5$ | 96 g | $7.3 \times 10^3$ |
| 18 | A-18 | $HOOCCH_2$— | 5 g | —$C_3H_7$ | 95 g | $5.8 \times 10^3$ |
| 19 | A-19 | HOOC—CH(HOOC—$CH_2$)— | 5 g | —$CH_2C_6H_5$ | 95 g | $7.5 \times 10^3$ |
| 20 | A-20 | $HOOCCH_2CH_2$— | 5.5 g | —$C_6H_5$ | 94.5 g | $6.5 \times 10^3$ |
| 21 | A-21 | $HOOCCH_2$— | 4 g | 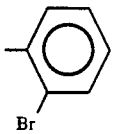 | 96 g | $5.3 \times 10^3$ |
| 22 | A-22 | HO—P(=O)(OH)—$OCH_2CH_2$— | 3 g | 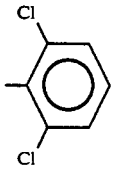 | 97 g | $6.0 \times 10^3$ |
| 23 | A-23 | $HO_3SCH_2CH_2CH_2$— | 3 g | 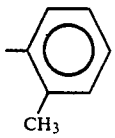 | 97 g | $8.8 \times 10^3$ |
| 24 | A-24 | $H_5C_2O$—P(=O)(OH)—$OCH_2CH_2$— | 4 g | 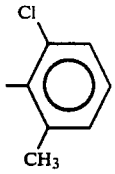 | 96 g | $7.5 \times 10^3$ |
| 25 | A-25 | 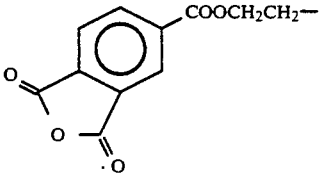 | 7 g | 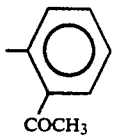 | 93 g | $5.5 \times 10^3$ |
| 26 | A-26 | $H_5C_2$—P(=O)(OH)—$OCH_2CH_2$— | 6 g | 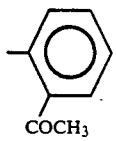 | 94 g | $4.5 \times 10^3$ |

TABLE 2-continued

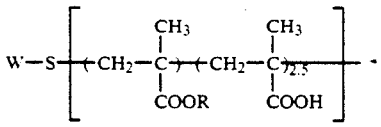

| Synthesis Example No. | Resin (A) | Mercapto Compound (W—) | | R— | | Weight Average Molecular Weight |
|---|---|---|---|---|---|---|
| 27 | A-27 | 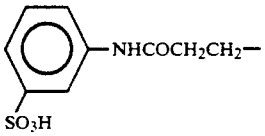 | 4 g | 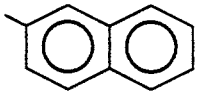 | 96 g | $5.6 \times 10^3$ |

SYNTHESIS EXAMPLE A-28

Synthesis of Resin (A-28)

A mixed solution of 97 g of 1-naphthyl methacrylate, 3 g of methacrylic acid, 150 g of toluene, and 50 g of isopropanol was heated to 80° C. under nitrogen gas stream. After adding 5.0 g of 4,4'-azobis(4-cyanovaleric acid) (hereinafter simply referred to as ACV) to the mixture, the resulting mixture was stirred for 5 hours. Then, after adding thereto 1 g of ACV, the mixture was stirred for 2 hours and, after further adding thereto 1 g of ACV, the mixture was stirred for 3 hours. The weight average molecular weight of the resulting copolymer (A-28) was $7.5 \times 10^3$.

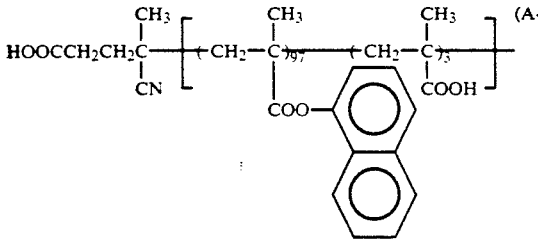

(A-28)

SYNTHESIS EXAMPLE A-29

Synthesis of Resin (A-29)

A mixed solution of 97 g of benzyl methacrylate, 3 g of vinylbenzenecarboxylic acid, 1.5 g of thiosalicylic acid, and 200 g of toluene was heated to 75° C. under nitrogen gas stream. Then, after adding 3.0 of ACV to the resulting mixture, the reaction was carried out for 6 hours and, after further adding thereto 0.4 g of AIBN, the reaction was carried out for 3 hours. An Mw of the resulting copolymer (A-29) was $5.8 \times 10^3$.

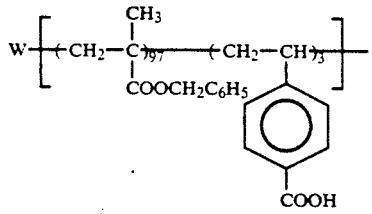

(A-29)

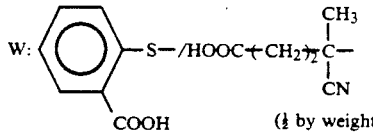

(½ by weight)

SYNTHESIS EXAMPLE B-1

Synthesis of Resin (B-1)

A mixed solution of 100 g of ethyl methacrylate, 1.0 g of ethylene glycol dimethacrylate, and 200 g of toluene was heated to 75° C. under nitrogen gas stream, and 1.0 g of AIBN was added thereto to conduct a reaction for 10 hours. The resulting copolymer, i.e., Resin (B-1) had a weight average molecular weight of $4.2 \times 10^5$.

SYNTHESIS EXAMPLES B-2 TO B-19

Synthesis of Resins (B-2) TO (B-19)

Resins (B) shown in Table 3 below were prepared under the same polymerization conditions as in Synthesis Example B-1, except for using the monomer and cross-linking monomer shown in Table 3 below, respectively.

TABLE 3

| Synthesis Example No. | Resin (B) | Monomer | Crosslinking Monomer | Mw of Resin (B) |
|---|---|---|---|---|
| 2 | B-2 | ethyl methacrylate (100 g) | propylene glycol dimethacrylate (1.0 g) | $2.4 \times 10^5$ |
| 3 | B-3 | butyl methacrylate (100 g) | diethylene glycol dimethacrylate (0.8 g) | $3.4 \times 10^5$ |
| 4 | B-3 | propyl methacrylate (100 g) | vinyl methacrylate (3 g) | $9.5 \times 10^5$ |
| 5 | B-5 | methyl methacrylate (80 g) ethyl acrylate (20 g) | divinylbenzene (0.8 g) | $8.8 \times 10^5$ |
| 6 | B-6 | ethyl methacrylate (75 g) methyl acrylate (25 g) | diethylene glycol diacrylate (0.8 g) | $2.0 \times 10^5$ |
| 7 | B-7 | styrene (20 g) butyl methacrylate (80 g) | triethylene glycol trimethacrylate (0.5 g) | $3.3 \times 10^5$ |
| 8 | B-8 | methyl methacrylate (40 g) | IPS-22GA (produced by | $3.6 \times 10^5$ |

TABLE 3-continued

| Synthesis Example No. | Resin (B) | Monomer | Crosslinking Monomer | Mw of Resin (B) |
|---|---|---|---|---|
| | | propyl methacrylate (60 g) | Okamura Seiyu K.K.) (0.9 g) | |
| 9 | B-9 | benzyl methacrylate (100 g) | ethylene glycol dimethacrylate (0.8 g) | $2.4 \times 10^5$ |
| 10 | B-10 | Butyl methacrylate (95 g) 2-hydroxyethyl methacrylate (5 g) | ethylene glycol dimethacrylate (0.8 g) | $2.0 \times 10^5$ |
| 11 | B-11 | ethyl methacrylate (90 g) acrylonitrile (10 g) | divinylbenzene (0.7 g) | $1.0 \times 10^5$ |
| 12 | B-12 | ethyl methacrylate (99.5 g) methacrylic acid (0.5 g) | triethylene glycol dimethacrylate (0.8 g) | $1.5 \times 10^5$ |
| 13 | B-13 | butyl methacrylate (70 g) phenyl methacrylate (30 g) | diethylene glycol dimethacrylate (1.0 g) | $2.0 \times 10^5$ |
| 14 | B-14 | ethyl methacrylate (95 g) acrylamide (5 g) | triethylene glycol dimethacrylate (1.0 g) | $2.4 \times 10^5$ |
| 15 | B-15 | propyl methacrylate (92 g) N,N-dimethylaminoethyl methacrylate (8 g) | divinylbenzene (1.0 g) | $1.8 \times 10^5$ |
| 16 | B-16 | ethyl methacrylate (70 g) methyl crotonate (30 g) | divinylbenzene (0.8 g) | $1.4 \times 10^5$ |
| 17 | B-17 | propyl methacrylate (95 g) diacetonacrylamide (5 g) | propylene glycol dimethacrylate (0.8 g) | $1.8 \times 10^5$ |
| 18 | B-18 | ethyl methacrylate (93 g) 6-hydroxyhexamethylene methacrylate (7 g) | ethylene glycol dimethacrylate (0.8 g) | $2.0 \times 10^5$ |
| 19 | B-19 | ethyl methacrylate (90 g) 2-cyanoethyl methacrylate (10 g) | ethylene glycol dimethacrylate (0.8 g) | $1.8 \times 10^5$ |

SYNTHESIS EXAMPLE B-20

Synthesis of Resin (B-20)

A mixed solution of 99 g of ethyl methacrylate, 1 g of ethylene glycol dimethacrylate, 150 g of toluene, and 50 g of methanol was heated to 70° C. under nitrogen gas stream, and 1.0 g of 4,4'-azobis(4-cyanopentanoic acid) was added thereto to conduct a reaction for 8 hours. The resulting copolymer; i.e., Resin (B-20) had a weight average molecular weight of $1.0 \times 10^5$.

SYNTHESIS EXAMPLES B-21 TO B-24

Synthesis of Resins (B-21) TO (B-24)

Resins (B) shown in Table 4 below were prepared under the same conditions as in Synthesis Example B-20, except for replacing 4,4'-azobis(4-cyanopentanoic acid) used as the polymerization initiator with each of the compounds shown in Table 4 below, respectively. The weight average molecular weight of each resin obtained was in a range of from $1.0 \times 10^5$ to $3 \times 10^5$.

TABLE 4

| Synthesis Example No. | Resin (B) | Polymerization Initiator R—N=N—R | R— |
|---|---|---|---|
| 21 | B-21 | 2,2'-azobis(2-cyanopropanol) | $HO-CH_2-C(CH_3)(CN)-$ |
| 22 | B-22 | 2,2'-azobis(2-cyanopentanol) | $HOCH_2CH_2CH_2-C(CH_3)(CN)-$ |
| 23 | B-23 | 2,2'-azobis[2-methyl-N-(2-hydroxyethyl)propionamide] | $HOCH_2CH_2NH-C(=O)-C(CH_3)(CH_3)-$ |
| 24 | B-24 | 2,2'-azobis{2-methyl-N-[1,1-bis-hydroxymethyl)-2-hydroxyethyl]-propionamide} | $HOH_2C-C(CH_2OH)_2-NH-C(=O)-C(CH_3)(CH_3)-$ |

SYNTHESIS EXAMPLE B-25

Synthesis of Resin (B-25)

A mixed solution of 99 g of ethyl methacrylate, 1.0 g of thioglycolic acid, 2.0 g of divinylbenzene, and 200 g of toluene was heated to 80° C. under nitrogen gas stream. To the mixture was added 0.8 g of 2,2'-azobis(-cyclohexane-1-carbononitrile) (hereinafter simply referred to as ACHN) to conduct a reaction for 4 hours. Then, 0.4 g of ACHN was added thereto, followed by reacting for 2 hours, and 0.2 g of ACHN was further added thereto, followed by reacting for 2 hours. The resulting copolymer, i.e., Resin (B-25) had a weight average molecular weight of $1.2\times10^5$.

SYNTHESIS EXAMPLES B-26 TO B-38

Synthesis of Resins (B-26) TO (B-38)

Resins (B) shown in Table 5 below were prepared under the same manner as in Synthesis Example B-25, except for replacing 2.0 g of divinylbenzene used as the cross-linking monomer with the polyfunctional monomer or oligomer shown in Table 5 below, respectively.

TABLE 5

| Synthesis Example No. | Resin (B) | Crosslinking Monomer or Oligomer | Mw |
|---|---|---|---|
| 26 | B-26 | ethylene glycol dimethacrylate (2.5 g) | $2.2\times10^5$ |
| 27 | B-27 | diethylene glycol dimethacrylate (3 g) | $2.0\times10^5$ |
| 28 | B-28 | vinyl methacrylate (6 g) | $1.8\times10^5$ |
| 29 | B-29 | isopropenyl methacrylate (6 g) | $2.0\times10^5$ |
| 30 | B-30 | divinyl adipate (10 g) | $1.0\times10^5$ |
| 31 | B-31 | diallyl gultaconate (10 g) | $9.5\times10^5$ |
| 32 | B-32 | IPS-22GA (produced by Okamura Seiyu K.K.) (5 g) | $1.5\times10^5$ |
| 33 | B-33 | triethylene glycol diacrylate (2 g) | $2.8\times10^5$ |
| 34 | B-34 | trivinylbenzene (0.8 g) | $3.0\times10^5$ |
| 35 | B-35 | polyethylene glycol #400 diacrylate (3 g) | $2.5\times10^5$ |
| 36 | B-36 | polyethylene glycol dimethacrylate (3 g) | $2.5\times10^5$ |
| 37 | B-37 | trimethylolpropane triacrylate (0.5 g) | $1.8\times10^5$ |
| 38 | B-38 | polyethylene glycol #600 diacrylate (3 g) | $2.8\times10^5$ |

SYNTHESIS EXAMPLES B-39 TO B-49

Synthesis of Resins (B-39) TO (B-49)

A mixed solution of 39 g of methyl methacrylate, 60 g of ethyl methacrylate, 1.0 g of each of the mercapto compounds shown in Table 6 below, 2 g of ethylene glycol dimethacrylate, 150 g of toluene, and 50 g of methanol was heated to 70° C. under nitrogen gas stream. To the mixture was added 0.8 g of AIBN to conduct a reaction for 4 hours. Then, 0.4 g of AIBN was further added thereto to conduct a reaction for 4 hours. The weight average molecular weight of each copolymer obtained was in a range of $9.5\times10^4$ to $2\times10^5$.

TABLE 6

| Synthesis Example No. | Resin (B) | Mercapto Compound |
|---|---|---|
| 39 | B-39 | $CH_2COOH$ \| $HSCHCOOH$ |
| 40 | B-40 | 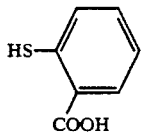 |
| 41 | B-41 | $HSCH_2CH_2NH_2$ |
| 42 | B-42 | $HSCH_2CH_2O-P(=O)(OH)-OH$ |
| 43 | B-43 | $HSCH_2CH_2O-P(=O)(OC_2H_5)-OH$ |
| 44 | B-44 | 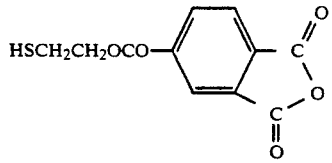 |
| 45 | B-45 | $HSCH_2CH_2COOH$ |
| 46 | B-46 | 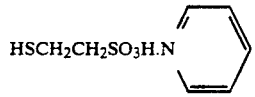 |
| 47 | B-47 | $HSCH_2CH_2NHCO(CH_2)_3COOH$ |
| 48 | B-48 | $HSCH_2CH_2N(CH_3)_2$ |
| 49 | B-49 | $HSCH_2CH_2OH$ |

EXAMPLE 1

A mixture of 6 g (solid basis, hereinafter the same) of Resin (A-2), 34 g (solid basis, hereinafter the same) of Resin (B-20), 200 g of zinc oxide, 0.018 g of Cyanine Dye (I) shown below, and 300 g of toluene was dispersed by a homogenizer (manufactured by Nippon Seiki K.K) at $1\times10^4$ r.p.m. for 10 minutes to prepare a coating composition for a light-sensitive layer. The coating composition was coated on paper, which had been subjected to electrically conductive treatment, by a wire bar at a dry coverage of 25 g/m$^2$, followed by drying at 110° C. for 30 seconds. The coated material was allowed to stand in a dark place at 20° C. and 65% RH (relative humidity) for 24 hours to prepare an electrophotographic light-sensitive material.

Cyanine Dye (I):

-continued

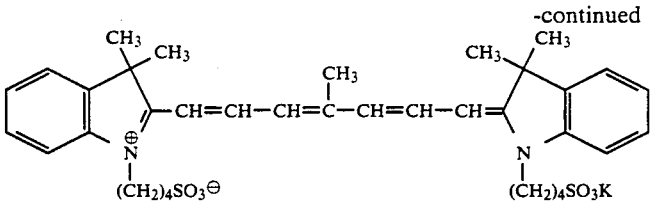

EXAMPLE 2

An electrophotographic light-sensitive material was prepared in the same manner as described in Example 1, except for using 6 g of Resin (A-8) in place of 6 g of Resin (A-2).

COMPARATIVE EXAMPLE A

An electrophotographic light-sensitive material was prepared in the same manner as described in Example 1 except that 6 g of Resin (R-1) for comparison having the following formula was used as a binder resin in place of 6 g of Resin (A-2).

Resin (R-1):

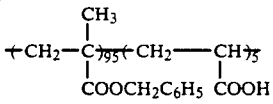

Mw: 6.3 × $10^3$ (weight ratio)

COMPARATIVE EXAMPLE B

An electrophotographic light-sensitive material was prepared in the same manner as described in Example 1 except that 6 g of Resin (R-2) for comparison having the following formula was used as a binder resin in place of 6 g of Resin (A-2).

Resin (R-2):

-continued

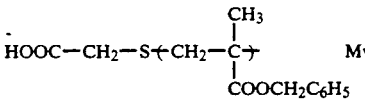

Mw: 6.3 × $10^3$

COMPARATIVE EXAMPLE C

An electrophotographic light-sensitive material was prepared in the same manner as described in Example 1 except that 40 g of Resin (R-2) described above was used as a binder resin in place of Resin (A-2) and Resin (B-20).

With each of the light-sensitive materials thus prepared, the film property (surface smoothness), the charging property (occurrence of uneven charging), and the pre-exposure fatigue resistance were determined.

Furthermore, the printing property (background stains and printing durability) were determined when each of the light-sensitive materials was used as an offset printing master plate.

The results obtained are shown in Table 7 below.

TABLE 7

| | Example 1 | Example 2 | Comparative Example A | Comparative Example B | Comparative Example C |
|---|---|---|---|---|---|
| Smoothness of Photoconductive Layer*1 (sec/cc) | 500 | 530 | 555 | 560 | 550 |
| Charging Property*2 (Uneven Charging) | Good (none) | Very Good (none) | Poor (uneven charging) | No Good (slight uneven charging) | Poor (uneven charging) |
| Pre-Exposure Fatigue Resistance*3 | | | | | |
| $V_{10}$ Recovery Ratio (%) | 90% | 98% | 75% | 80% | 80% |
| Image-Forming Performance | Good | Very Good | Very Poor (reduced Dmax, background fog, scratches of fine lines) | Poor (reduced Dmax, background fog) | Poor (reduced Dmax, background fog) |
| Printing Property*4 | | | | | |
| Background Stains of Light-Sensitive Material | None | None | None | None | None |
| Printing Durability | 8,000 | 8,000 | Background stains from the start of printing | Background stains from the start of printing | Background stains from the start of printing |

The evaluations described in Table 7 above were conducted as follows.

*1) Smoothness of Photoconductive Layer:

The smoothness (sec/cc) of the light-sensitive material was measured using a Beck's smoothness test machine (manufactured by Kumagaya Riko K.K.) under an air volume condition of 1 cc.

*2) Charging Property:

The light-sensitive material was allowed to stand one day under the condition of 20° C. and 65% RH. Then, after modifying parameters of a full-automatic plate making machine (ELP-404V, manufactured by Fuji Photo Film Co., Ltd.) to the forced conditions of a charging potential of −4.5 kV and a charging speed of 20 cm/sec, the light-sensitive material was treated with the machine using a solid black image as an original and a toner (ELP-T, manufactured by Fuji Photo Film Co., Ltd.). The solid black image thus obtained was visually evaluated with respect to the presence of unevenness of charging and density in the solid black portion.

*3) Pre-Exposure Fatigue Resistance:

$V_{10}$ Recovery Ratio:

After applying a corona discharge to the light-sensitive material in a dark place at 20° C. and 65% RH using a paper analyzer (Paper Analyzer Type SP-428, manufactured by Kawaguchi Denki K.K.) for 20 seconds at −6 kV, the light-sensitive material was allowed to stand for 10 seconds, and a surface potential $V_{10}A$ at the point of time was measured.

On the other hand, after exposing the light-sensitive material to a fluorescent lamp for 20 seconds at a distance of 2 meters (500 lux), the light-sensitive material was allowed to stand in a dark place for 10 seconds, and then a surface potential $V_{10}B$ was measured in the same manner as $V_{10}A$ above. The $V_{10}$ recovery ratio was calculated by the following equation: $(V_{10}B/V_{10}A)\times 100(\%)$.

Image-Forming Performance:

The light-sensitive material was allowed to stand one day in a dark place at 20° C. and 65% RH. Then, the light-sensitive material was subjected to the above described pre-exposure, thereafter charged to −5 kV, irradiated by scanning with a gallium-aluminum-arsenic semiconductor laser (oscillation wavelength: 780 nm) of 2.8 mW output as a light source in an exposure amount on the surface of 50 erg/cm$^2$, at a pitch of 25 μm and a scanning speed of 330 meters/sec., and then developed using ELP-T (manufactured by Fuji Photo Film Co., Ltd.) as a liquid developer followed by fixing. The duplicated image thus formed was visually evaluated for fog and image quality.

*4) Printing Property:

Background Stains of Light-Sensitive Material:

After subjecting the photoconductive layer surface of the light-sensitive material to an oil-desensitizing treatment by passing once the light-sensitive material through an etching processor using a solution obtained by diluting twice an oil-desensitizing solution (ELP-EX, manufactured by Fuji Photo Film Co., Ltd.) with distilled water, the light-sensitive material thus-treated was mounted on an offset printing machine (Oliver Type 52, manufactured by Sakurai Seisakusho K.K.) as an offset master plate for printing, and the extent of background stains occurred on prints was visually evaluated.

Printing Durability:

The light-sensitive material was subjected to the plate making under the same condition as described above for the image-forming performance of the pre-exposure. Then, the photoconductive layer of the master plate was subjected to an oil-desensitizing treatment by passing twice the master plate through the etching processor using the oil-desensitizing solution ELP-EX. The resulting plate was mounted on the offset printing machine in the same manner as described above as an offset master for printing, and the number of prints obtained without the occurrence of background stains in the non-image portions of the prints and problems on the image quality of the image portions was determined. The larger the number of the prints, the better the printing durability.

As is apparent from the results shown in Table 7, each of the electrophotographic light-sensitive materials according to the present invention had the photoconductive layer of good smoothness. Also, at the electrostatic charging, uniform charging property was observed without causing uneven charging. Further, under the condition wherein the light-sensitive material which had been pre-exposed prior to making a printing plate, the recovery was very good and the characteristics were almost the same as those obtained under no pre-exposure condition. The duplicated images had no background fog and the image quality was good. This is assumed to be based on that the photoconductive substance, the spectral sensitizer and the binder resin are adsorbed each other in an optimum state and the state is stably maintained.

Also, when the light-sensitive material was subjected to an oil-desensitizing treatment with an oil-desensitizing solution without conducting the plate making procedure and a contact angle between the surface thus treated and a water drop was measured. The contact angle was as small as 10 degree or less, which indicated that the surface was sufficiently rendered hydrophilic. When printing was conducted, the background stains of the prints was not observed.

Furthermore, when a printing plate was prepared from the light-sensitive material and used, since the light-sensitive material had good charging property and pre-exposed fatigue resistance, the duplicated images obtained was clear and had no background fog. Thus, the oil-desensitization with an oil-desensitizing solution sufficiently proceeded and, after printing 10,000 prints, the prints had no background stains and showed clear image quality.

As shown in Example 2, when the electrophotographic light-sensitive material of the present invention contained the resin (A') having the methacrylate component of the specific substituent, the charging property and the pre-exposure fatigue resistance were more improved.

On the other hand, in Comparative Examples A and B each using a known low-molecular weight resin, the uneven charging occurred under the severe condition. Also, the pre-exposure fatigue was large which influenced on the image forming performance to deteriorate the quality of duplicated images (occurrence of background fog, cutting of fine lines and letters, decrease in density, etc.). Also, when the oil-desensitization treatment with an oil-desensitizing solution was conducted, it was confirmed that the light-sensitive materials in the comparative examples showed no background stains on the prints, and the surface of the photoconductive layer was sufficiently rendered hydrophilic. However, when the light-sensitive material for comparison was subjected to plate making and conducted the oil-desensitizing treatment, and used for printing as an offset master plate, prints obtained showed background stains in the non-image portions from the start of printing and the image quality of the image portions was deteriorated (cutting of fine lines and letters, decrease in density, etc.). This means that the degradation of the image quality of the master plate obtained by plate making appears on the prints as it is without being compensated by the oil-desensitizing treatment and, hence, the plate cannot be practically used.

With Comparative Example C using the conventionally known low-molecular weight resin alone, all the characteristics are almost same as the cases of Comparative Examples A and B. Further, since the film strength of the photoconductive layer was not sufficient, the layer was damaged after obtaining several hundred prints during the printing durability evaluation.

Thus, it can be seen that only the light-sensitive materials according to the present invention are excellent in all aspects of the smoothness of the photoconductive layer, electrostatic characteristics, and printing property.

EXAMPLES 3 TO 12

By following the same procedure as Example 1 except that 6 g of each of Resins (A) and 34 g of each of Resins (B) shown in Table 8 below were used in place of Resin (A-2) and Resin (B-20), each of the electrophotographic light-sensitive materials shown in Table 8 was produced.

TABLE 8

| Example No. | Resin (A) | Resin (B) |
|---|---|---|
| 3 | A-4 | B-4 |
| 4 | A-5 | B-5 |
| 5 | A-7 | B-6 |
| 6 | A-8 | B-7 |
| 7 | A-9 | B-8 |
| 8 | A-10 | B-9 |
| 9 | A-12 | B-10 |
| 10 | A-13 | B-11 |
| 11 | A-14 | B-20 |
| 12 | A-15 | B-21 |
| 13 | A-18 | B-24 |
| 14 | A-19 | B-25 |
| 15 | A-22 | B-26 |
| 16 | A-23 | B-33 |
| 17 | A-26 | B-39 |
| 18 | A-29 | B-44 |

As shown in Table 8 above, the light-sensitive materials of the present invention were excellent in the charging property, dark charge retention rate and photosensitivity, and provided clear duplicated images having no background fog even under the high-temperature and high-humidity conditions (30° C. and 80% RH) or the pre-exposure fatigue condition.

Furthermore, when each of the light-sensitive materials was subjected to plate making and used for printing as an offset printing master plate, more than 7,000 prints having clear images of no background stains were obtained.

EXAMPLES 19 TO 26

By following the same procedure as Example 1 except that 6.5 g of each of Resins (A) and 33.5 g of each of Resins (B) shown in Table 9 below were used as the binder resin and 0.018 g of Dye (II) shown below was used in place of 0.018 g of Cyanine Dye (I), each of the electrophotographic light-sensitive materials was prepared.

TABLE 9

| Example No. | Resin (A) | Resin (B) |
|---|---|---|
| 19 | A-17 | B-1 |
| 20 | A-19 | B-5 |
| 21 | A-22 | B-11 |
| 22 | A-23 | B-16 |
| 23 | A-24 | B-19 |
| 24 | A-25 | B-20 |
| 25 | A-26 | B-34 |
| 26 | A-7 | B-43 |

Each of the electrophotographic light-sensitive material of the present invention had excellent charging property and pre-exposure fatigue resistance, and, upon the duplication using it under the severe conditions, clear images having no occurrence of background fog and cutting of fine lines were obtained. Furthermore, when printing was conducted using an offset printing master plate prepared therefrom, more than 8,000 prints having clear images of no background stains in the non-image portions were obtained.

EXAMPLE 27

A mixture of 6.5 g of Resin (A-1), 33.5 g of Resin (B-9), 200 g of zinc oxide, 0.03 g of uranine, 0.075 g of Rose Bengale, 0.045 g of bromophenol blue, 0.1 g of phthalic anhydride, and 240 g of toluene was dispersed by a homogenizer at $1\times10^4$ r.p.m. for 10 minutes to prepare a coating composition for a light-sensitive layer. The coating composition was coated on paper, which had been subjected to electrically conductive treatment, by a wire bar at a dry coverage of 20 g/m$^2$ followed by heating at 110° C. for 30 seconds, and then allowed to stand in a dark place for 24 hours at 20° C. and 65% RH to prepare an electrophotographic light-sensitive material.

COMPARATIVE EXAMPLE D

By following the same procedure as Example 27 except that 6.5 g of Resin (R-1) used in Comparative Example A described above was used in place of 6.5 g of Resin (A-1), an electrophotographic light-sensitive material was produced.

COMPARATIVE EXAMPLE E

By following the same procedure as Example 27 except that 6.5 g of Resin (R-2) used in Comparative Example B described above was used in place of 6.5 g of Resin (A-1), an electrophotographic light-sensitive material was produced.

COMPARATIVE EXAMPLE F

By following the same procedure as Example 27 except that 40 g of Resin (R-2) used in Comparative Example B described above was used in place of Resin (A-1) and Resin (B-9) as the binder resin, an electrophotographic light-sensitive material was produced.

Dye (II):

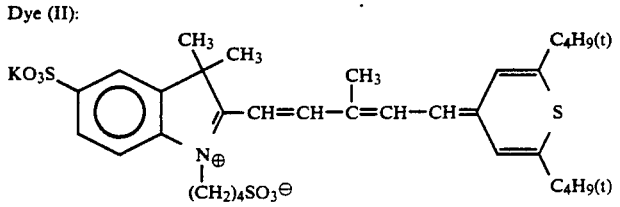

With each of the light-sensitive materials thus prepared, the film property (surface smoothness), the charging property (occurrence of uneven charging), and the pre-exposure fatigue resistance were determined. Furthermore, each of the light-sensitive materials was used as an offset printing master plate, and the printing property (background stains and printing durability) of the resulting plate was determined.

The results obtained are shown in Table 10 below.

TABLE 10

| | Example 27 | Comparative Example D | Comparative Example E | Comparative Example F |
|---|---|---|---|---|
| Smoothness of Photoconductive Layer (sec/cc) | 600 | 580 | 530 | 565 |
| Charging Property (Uneven Charging) | Good (none) | Poor (uneven charging) | No Good (slight uneven charging) | Poor (uneven charging) |
| Pre-Exposure Fatigue Resistance | | | | |
| $V_{10}$ Recovery Ratio (%) | 95% | 73% | 81% | 78% |
| Image-Forming Performance[5)] | Very Good | Very Poor (reduced Dmax, backgroupd fog, scratches of fine lines) | Poor (reduced Dmax, backgroupd fog) | Poor (reduced Dmax, backgroupd fog) |
| Printing Property | | | | |
| Background Stains of Light-Sensitive Material | None | None | None | None |
| Printing Durability[6)] | 8,000 | Background stains from the start of printing | Background stains from the start of printing | Background stains from the start of printing |

The image forming performance and the printing durability in Table 10 were evaluated as follows. The other evaluations were conducted in the same manner as described in Example 1.

*5) Image Forming Performance After Pre-exposure:

The light-sensitive material was allowed to stand one day in a dark place at 20° C. and 65% RH. Then, after conducting the pre-exposure under the same conditions as described in *3) above, the light-sensitive material was subjected to plate making by ELP-404V using ELP-T (toner), and the duplicated image obtained was visually evaluated.

*6) Printing Durability:

The light-sensitive material was subjected to the plate making under the same conditions as described in the image forming performance of *5) above. Then, the master plate was subjected to the oil-desensitizing treatment, the printing was conducted in the same manner as in the printing durability of *4) described above, and the resulting prints were evaluated.

The electrophotographic light-sensitive material of the present invention had a sufficient smoothness of the photoconductive layer, caused no uneven charging, and, also, even when pre-exposure was applied thereto, the effect of pre-exposure was recovered very quickly. Also, the duplicated images having no background fog were stably obtained. Further, when it was used as an offset printing plate, the non-image portions were sufficiently rendered hydrophilic and after printing 8,000 prints, further prints having clear images of no background stains were obtained.

On the other hand, with Comparative Examples D and E each using the known low-molecular weight resin, the charging property and pre-exposure fatigue resistance were lowered and, in the duplicated images formed, background fog, decrease in density, cutting of fine lines and letters were observed. Also, when the light-sensitive material was used as an offset master plate, stains occurred on the prints and the image quality of the prints was degraded. Thus, they could not be practically used. Although the sample of Comparative Example F was exhibited the same level of image forming performance as the sample of Comparative Example D, the damage of the photoconductive layer occurred after obtaining several hundred prints during the printing durability evaluation.

Thus, it can be seen that the electrophotographic light-sensitive material having sufficient electrostatic characteristics and printing suitability was obtained only in the case of using the binder resin according to the present invention.

EXAMPLES 28 TO 35

By following the same procedure as Example 27 except that 6.0 g of each of Resins (A) and 34.0 g of each of Resins (B) shown in Table 11 below were used in place of Resin (A-1) and Resin (B-9), each of the electrophotographic light-sensitive materials was produced.

TABLE 11

| Example No. | Resin (A) | Resin (B) |
|---|---|---|
| 28 | A-1 | B-2 |
| 29 | A-2 | B-5 |
| 30 | A-6 | B-11 |
| 31 | A-8 | B-13 |
| 32 | A-13 | B-23 |
| 33 | A-14 | B-37 |
| 34 | A-22 | B-45 |
| 35 | A-27 | B-47 |

The characteristics of each of the light-sensitive materials were determined in the same manner as in Example 27. The results indicated that each of the light-sensitive materials was excellent in charging property and pre-exposure fatigue resistance, and by the formation of duplicated images under severe conditions, clear images having neither background fog nor cutting of fine lines were obtained.

Furthermore, when printing was conducted using the offset printing master plate obtained by the plate making of the light-sensitive material, more than 7,000 prints having clear images of no background stains in the non-image portions were obtained.

EXAMPLE 36

A mixture of 6.5 g of Resin (A-30) shown below, 3.5 g of Resin (B-28), 200 g of zinc oxide, 0.03 g of uranine, 0.040 g of Methine Dye (III) shown below, 0.035 g of Methine Dye (IV) shown below, 0.15 g of salicylic acid, and 240 g of toluene was dispersed by a homogenizer at $1\times10^4$ r.p.m. for 10 minutes, then 0.5 g of glutaric anhydride was added thereto and further dispersed by a homogenizer at $1\times10^3$ r.p.m. for one minute to prepare a coating composition for a light-sensitive layer.

The coating composition was coated on paper, which had been subjected to electrically conductive treatment, by a wire bar at a dry coverage of 22 g/m$^2$ followed by heating at 110° C. for 15 seconds and, after further heating at 140° C. for 2 hours, allowed to stand for 24 hours in a dark place at 20° C. and 65% RH to prepare an electrophotographic light-sensitive material.

The characteristics of the light-sensitive material were determined in the same manners as in Example 27.

The smoothness of the photoconductive layer was 225 (sec/cc) and the charging property was uniform and good. The pre-exposure fatigue resistance was the $V_{10}$ recovery ratio of 93% and the image forming performance was good. Also, when it was subjected to the oil-desensitizing treatment and used as an offset printing mater plate, no background stains were observed. When printing was conducted using the printing plate prepared therefrom, more than 10,000 prints having clear images of no background stains were obtained.

EXAMPLES 37 TO 40

By following the same procedure as Example 36 except that each of the compounds shown in Table 12 below was used in place of 6.5 g of Resin (A-30) and 0.5 g of glutaric anhydride as crosslinking agent, and also 33 g of Resin (B-29) was used in place of Resin (B-28), each of the electrophotographic light-sensitive materials was produced.

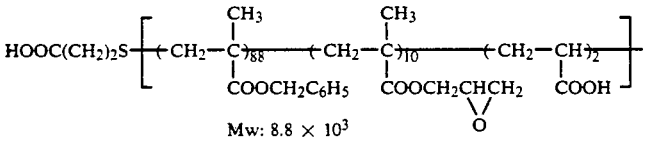

(A-30)

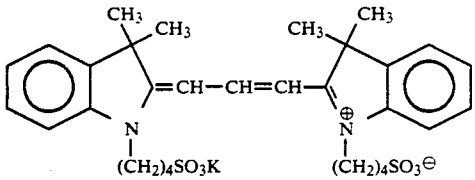

Methine Dye (III)

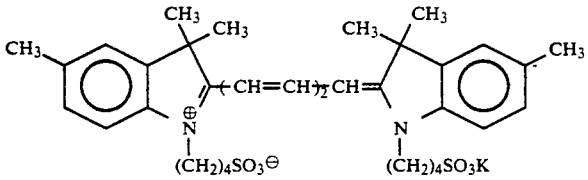

Methine Dye (IV)

TABLE 12

| Example No. | Resin (A) | Resin (A) (weight ratio) | Crosslinking Agent and Amount Used |
|---|---|---|---|
| 37 | (A-31) | 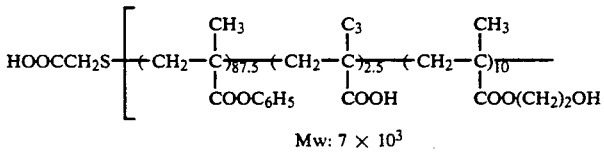 | 1,6-Hexanediisocyanate 1 g |
| 38 | (A-32) | 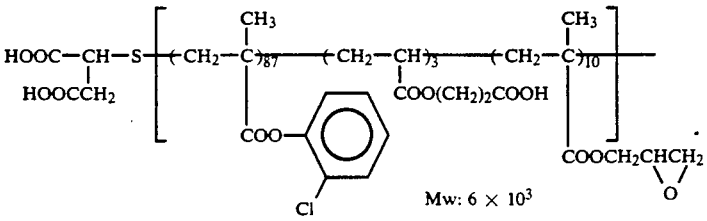 | 3-(N,N-dimethylamino)propylamine 0.8 g |

TABLE 12-continued

| Example No. | Resin (A) | Resin (A) (weight ratio) | Crosslinking Agent and Amount Used |
|---|---|---|---|
| 39 | (A-33) | 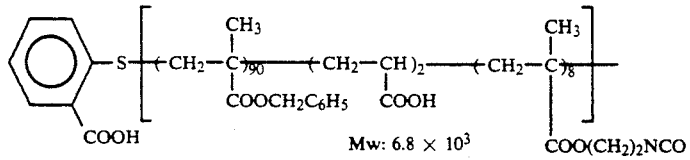 Mw: $6.8 \times 10^3$ | 1,6-Butanediol 0.8 g |
| 40 | (A-34) | 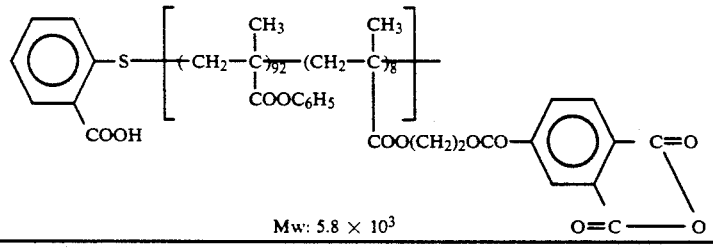 Mw: $5.8 \times 10^3$ | Hexamethylenediamine 0.6 g |

With each of the light-sensitive material, the characteristics were evaluated same as in Example 27.

As a result, each light-sensitive material was good in the charging property and pre-exposure fatigue resistance, and by the formation of duplicated image even under severe conditions, clear images of neither background fog nor cutting of fine lines were obtained. Furthermore, when it was used as an offset master printing plate after making printing plate, more than 8,000 prints having clear images of no background stains in the non-image portions were obtained.

While the invention has been described in detail and with reference to specific embodiments thereof, it will be apparent to one skilled in the art that various changes and modifications can be made therein without departing from the spirit and scope thereof.

What is claimed is:

1. An electrophotographic light-sensitive material comprising a support having provided thereon a photoconductive layer formed from a dispersion containing at least an inorganic photoconductive substance, a spectral sensitizer and a binder resin, wherein the binder resin contains (1) at least one resin (Resin (A)) having a weight average molecular weight of from $1\times10^3$ to $1\times10^4$ which contains at least 30% by weight of a polymer component represented by the general formula (I) described below and from 0.1 to 10% by weight of a polymer component containing at least one acidic group selected from $-PO_3H_2$, $-SO_3H$, $-COOH$,

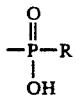

(wherein R represents a hydrocarbon group or —OR' (wherein R' represents a hydrocarbon group)) and a cyclic acid anhydride-containing group, and which has at least one acidic group selected from the above-described acidic groups at one terminal of the main chain of the copolymer;

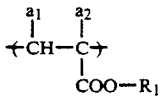

(I)

wherein $a_1$ and $a_2$ each represents a hydrogen atom, a halogen atom, a cyano group or a hydrocarbon group; and $R_1$ represents a hydrocarbon group; and (2) at least one resin (Resin (B)) having a weight average molecular weight of $5\times10^4$ or more, containing a recurring unit represented by the general formula (III) described below as a copolymer component, and having a cross-linked structure made before the preparation of the dispersion for forming the photoconductive layer:

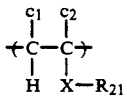

(III)

wherein X represents —COO—, —OCO—, $-CH_2OCO-$, $-CH_2COO-$, —O—, or $-SO_2-$; $R_{21}$ represents a hydrocarbon group having from 1 to 22 carbon atoms; and $c_1$ and $c_2$, which may be the same or different, each represents a hydrogen atom, a halogen atom, a cyano group, a hydrocarbon group having from 1 to 8 carbon atoms, $-COOZ_1$, or $-COOZ_1$ bonded through a hydrocarbon group having from 1 to 8 carbon atoms, wherein $Z_1$ represents a hydrocarbon group having from 1 to 18 carbon atoms.

2. An electrophotographic light-sensitive material as claimed in claim 1, wherein the polymer component represented by the general formula (I) is a polymer component represented by the following general formula (IIa) or (IIb):

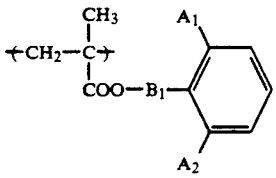

(IIa)

-continued

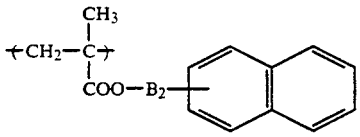

(IIb)

wherein $A_1$ and $A_2$ each represents a hydrogen atom, a hydrocarbon group having from 1 to 10 carbon atoms, a chlorine atom, a bromine atom, $—COD_1$ or $—COOD_2$, wherein $D_1$ and $D_2$ each represents a hydrocarbon group having from 1 to 10 carbon atoms; and $B_1$ and $B_2$ each represents a mere bond or a linking group containing from 1 to 4 linking atoms, which connects —COO— and the benzene ring.

3. An electrophotographic light-sensitive material as claimed in claim 2, wherein the linking group containing from 1 to 4 linking atoms represented by $B_1$ or $B_2$ is $-(CH_2)-_{n1}$ ($n_1$ represents an integer of 1, 2 or 3), $—CH_2OCO—$, $—CH_2CH_2OCO—$, $-(CH_2O)-_{n2}$ ($n_2$ represents an integer of 1 or 2), or $—CH_2CH_2O—$.

4. An electrophotographic light-sensitive material as claimed in claim 1, wherein the content of the polymer component represented by the general formula (I) is from 50 to 97% by weight.

5. An electrophotographic light-sensitive material as claimed in claim 1, wherein the content of the polymer component containing the acidic group in the resin (A) is from 0.5 to 8% by weight.

6. An electrophotographic light-sensitive material as claimed in claim 1, wherein the acidic group which is bonded to the terminal of the polymer main chain of the resin (A) is $—PO_3H_2$, $—SO_3H$, —COOH,

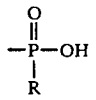

or a cyclic acid anhydride-containing group.

7. An electrophotographic light-sensitive material as claimed in claim 1, wherein the resin (A) further contains from 1 to 20% by weight of a copolymer component having a heat-and/or photo-curable functional group.

8. An electrophotographic light-sensitive material as claimed in claim 7, wherein the photoconductive layer further contains a crosslinking agent.

9. An electrophotographic light-sensitive material as claimed in claim 1, wherein the weight average molecular weight of the resin (B) is from $8\times10^4$ to $6\times10^5$.

10. An electrophotographic light-sensitive material as claimed in claim 1, wherein the resin (B) has at least one polar group selected from $—PO_3H_2$, $—SO_3H$, —COOH, —OH, —SH,

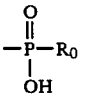

(wherein $R_0$ represents a hydrocarbon group or $—OR_0'$, wherein $R_0'$ represents a hydrocarbon group), a cyclic acid anhydride-containing group, —CHO, $—CONH_2$, $—SO_2NH_2$, and

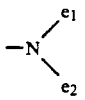

(wherein $e_1$ and $e_2$, which may be the same or different, each represents a hydrogen atom or a hydrocarbon group) at only one terminal of at least one polymer main chain thereof.

11. An electrophotographic light-sensitive material as claimed in claim 1, wherein a ratio of the resin (A)/the resin (B) is 5 to 50/95 to 50.

12. An electrophotographic light-sensitive material as claimed in claim 1, wherein the spectral sensitizer is a polymethine dye capable of spectrally sensitizing in the wavelength region of 700 nm or more.

13. An electrophotographic light-sensitive material as claimed in claim 1, wherein the photoconductive layer further contains a chemical sensitizer.

* * * * *